US008628124B2

(12) United States Patent
Kutschat

(10) Patent No.: US 8,628,124 B2
(45) **Date of Patent: *Jan. 14, 2014**

(54) VEHICLE DOOR LOCK

(71) Applicant: D. La Porte Söhne GmbH, Wuppertal (DE)

(72) Inventor: Horst Kutschat, Wuppertal (DE)

(73) Assignee: D. La Porte Söhne GmbH, Wuppertal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/632,461

(22) Filed: Oct. 1, 2012

(65) Prior Publication Data

US 2013/0049378 A1 Feb. 28, 2013

Related U.S. Application Data

(63) Continuation-in-part of application No. 11/990,672, filed as application No. PCT/EP2006/008610 on Sep. 4, 2006, now Pat. No. 8,276,950.

(30) Foreign Application Priority Data

Sep. 27, 2005 (DE) ..... 10 2005 045 808
Mar. 21, 2006 (DE) ..... 10 2006 012 956

(51) Int. Cl.
*E05C 3/04* (2006.01)

(52) U.S. Cl.
USPC ..... 292/118; 292/213; 292/201

(58) Field of Classification Search
USPC ..... 292/118, 216, 213, DIG. 23, 201
See application file for complete search history.

(56) References Cited

U.S. PATENT DOCUMENTS

| | | | | |
|---|---|---|---|---|
| 4,756,563 | A * | 7/1988 | Garwood et al. | 292/216 |
| 5,071,178 | A * | 12/1991 | Brackman et al. | 292/216 |
| 2004/0113441 | A1 | 6/2004 | Lane et al. | |

FOREIGN PATENT DOCUMENTS

| | | | |
|---|---|---|---|
| DE | 40 06 592 | | 9/1990 |
| DE | 196 53 169 | A1 | 6/1998 |
| DE | 10 2004 020 655 | A1 | 11/2004 |
| EP | 1 096 086 | A2 | 5/2001 |
| WO | WO/2007/036283 | A1 | 4/2007 |

* cited by examiner

*Primary Examiner* — Carlos Lugo
*Assistant Examiner* — Mark Williams
(74) *Attorney, Agent, or Firm* — Brinks Gilson & Lione

(57) ABSTRACT

A rotary latch lock for a vehicle door has a lock case forming a cut-out recess for a lock pin; a first rotatably mounted rotary latch engageable with the lock pin; a first rotary latch spring for imposing a force on the first rotary latch; a rotatably mounted actuating lever engaging in the lock case; a first locking pawl pivoting about a first pivot axis; and a guide device for locating, centering and guiding the vehicle door during opening and closing of the vehicle door. The first rotary latch, the first latch spring and the first locking pawl are arranged within the lock case. The first locking pawl engages the first rotary latch, causing the first rotary latch to be maintained in a locked position engaging the lock pin. The actuating lever actuates the first locking pawl, causing it to release the first rotary latch from its locked position.

14 Claims, 21 Drawing Sheets

PRIOR ART

VEHICLE DOOR LOCK

CROSS REFERENCE TO RELATED APPLICATIONS

This application is a Continuation Application of U.S. patent application Ser. No. 11/990,672, filed on Feb. 19, 2008, entitled "VEHICLE DOOR LOCK", which claims priority to DE 10 2005 045 808.4, filed Sep. 27, 2005, DE 10 2006 012 956.3, filed Mar. 21, 2006, and PCT/EP2006/008610, filed Sep. 4, 2006, each of which is hereby incorporated by reference in its entirety.

FIELD OF THE INVENTION

The invention relates to a vehicle door lock having a rotary latch arrangement for locking and closing the doors of motor vehicles, in particular the doors of agricultural machines, for example tractors.

BACKGROUND OF THE INVENTION

A door lock of the above mentioned kind has been previously disclosed, for example, in DE 196 53 169 A1 (FIG. 26). This vehicle door lock exhibits a flat, rectangular lock case 200 (referring to the element number used in that reference) having a horizontal base wall 201 of the case, a case cover (not illustrated) arranged parallel thereto, two horizontal transversal case walls 202 and 203 running perpendicular to the base wall 201 of the case, and two vertically oriented longitudinal case walls 204 and 205, which door lock is arranged on a vehicle door (not illustrated) of a vehicle and contains the component parts necessary for its locking closure. In the direction towards a lock pin 206 projecting horizontally on the door pillar, the base wall 201 of the case and the longitudinal wall 204 of the case have a recess 207, in which the lock pin 206 is accommodated with the door in its closed state.

Adjacent to the recess 207 above and below this and arranged vertically in alignment with one another and slightly apart from one another, each lock case 200 has a rotary latch 209 capable of pivoting about a rotary latch swivel pin 208. The rotary latches 209 are plate-shaped elements, which has noses 210 projecting outwards beyond the lock case 200 in the direction of the lock pin 206. Each of the noses 210 has a throat 211 in a peripheral wall 212 of the rotary latch 209. The throats 211 in the noses 210 face one another.

Provided in addition are two rotary latch spiral springs 213, of which only one is represented, which are arranged around the rotary latch swivel pins 208. These rotary latch spiral springs 213 are supported in each case by a spring limb on a projecting part 214, which is formed on the rotary latches 209 lying more or less diametrically opposite the throats 211 and by a second spring limb internally on the longitudinal wall 204 of the case (not illustrated), and endeavor to hold the rotary latches 209 in an opened position, that is to say to force apart the noses 210 which face one another.

Furthermore, two adjacent and essentially V-shaped detent recesses 215 and 216 are each introduced into the peripheral walls 212 of the rotary latches 209, the detent recesses 215 and 216 lying opposite both rotary latches 209 with the lock in the open position.

In the vicinity of the lock case 200 lying opposite the recess 207, a detent lever or a locking pawl 217 is arranged between the rotary latches 209 and the longitudinal wall 205 of the case. The detent lever 217 is capable of pivoting about a detent lever swivel pin 218, which is arranged horizontally in a corner area of the lock case 200 adjacent to the longitudinal wall 205 of the case and the transversal wall 202 of the case. Formed at one end of the detent lever 217 is a locking piece 219 facing towards the rotary latches 209, which locking piece exhibits two end edges 220 and 221 and, on the rotary latch side, a longitudinal edge 222 connecting the end edges 220 and 221, in conjunction with which a longitudinal edge throat 223 is introduced into the longitudinal edge 222, so that a lever detent nose 224 and 225 is produced in each case. The locking piece 219 in the open position initially makes contact with the lever detent noses 224 and 225 on the peripheral wall 212 of the rotary latches 209 under the effect of the pressure exerted by, for example, a spiral detent lever spring (not illustrated), which spring is arranged, for example, around the detent lever swivel pin 218 and is supported by its detent lever spring legs on the longitudinal wall 205 of the case and on a lever bolt 226 provided at the free end of the detent lever 217.

When a vehicle door is closed, the lock pin 206 that is arranged horizontally on the door pillar arrives in the vicinity of the throats 211 in the rotary latches 209. Through the effect of the pressure exerted by the lock pin 206 on the rotary latches 209, these are caused to pivot about the rotary latch swivel pins 208 against the pressure of the rotary latch spiral springs 213 in a mutually opposite direction of rotation. As a result of the rotating movement, the noses 210 arrive at a position behind the lock pin 206 and engage around it. In the closed position, the lock pin 206 is situated between both of the rotary latches 209 in the vicinity of the throats 211. Pivoting of the rotary latches 209 initially causes the first V-shaped detent recesses 215 to arrive in the vicinity of the locking piece 219, in conjunction with which, as a result of the pressure of the detent lever springs, the lever detent noses 224 and 225 latch into the first detent recesses 215. In this so-called safety catch position, the lock is not completely closed, although it can no longer be opened because of the locking effect of the detent lever 217. In the event of further pivoting of the rotary latches 209, the locking piece 219 together with the lever detent noses 224 and 225 arrives in each case in a second detent recess 216 in the rotary latches 209 and latches in position there. Each of the rotary latches 209 is now supported by the flanks of the detent recesses 216 on a flank of the lever detent noses 224 and 225 of the detent piece 219 and is retained in this way in the closed position against the pressure exerted by the rotary latch springs 213.

Opening the vehicle lock, and with it the door, will cause a system of levers (not illustrated) present in the door to be actuated. This system of levers exhibits a U-shaped lever, which acts on the lever bolt 226 of the detent lever 217, for example, or is executed in a single piece with the detent lever 217 and forces this out from the detent recesses 215 or 216 against the pressure exerted by the detent lever spring and the rotary latch springs 213. If the lever detent noses 224 and 225 have left the detent recesses 215 and 216, the rotary latches 209 engage back into their initial position under the effect of the rotary latch springs 213, that is to say the opened lock position. The lock pin 206 is moved outwards from the lock case 200 by the flanks of the throats 211.

This vehicle lock according to the prior art has proven its worth in service. However, vehicle doors, in particular in agricultural vehicles, are increasingly manufactured from glass and have a tendency to become larger and heavier, so that a weight of 70-80 kg is imposed on the locks of these doors in some cases. The consequence of this is that the vehicle locks must also be made increasingly large and robust, in conjunction with which the release forces required to open and close the vehicle locks also increase due to their physical dimension. Furthermore, the geometry of the detent noses of the two rotary latches and the geometry of the detent lever is relatively intricate in terms of its design and manufacture, as everything is required to be accurately matched, and the detent noses exhibit a different physical form because of the pivoting movement of the detent lever.

A further problem area associated with heavy vehicle doors of this kind is the high forces which act on the rotary latches and the lock pins in conjunction with opening and closing the vehicle doors in the event that the vehicle door is no longer hung in a precisely centered manner, as a consequence of which the lock pin is not introduced into the throat and the rotary latches in a precisely centered manner, but slides along one side of the throat, and the vehicle door with its high weight is only centered during the closing operation. If excessively high forces act on the lock pin, this can lead to bending or even fracture of the lock pin. In any case, the service life of a door lock of this kind is reduced significantly by these high forces.

The object of the invention is to provide a vehicle door lock, which can be manufactured economically and simply, is easy to assemble, and in which the release forces required to be applied for opening and closing are as small as possible. A further object of the invention is to make available a vehicle door lock, in which the forces acting upon the lock pins and the rotary latches are significantly reduced in the case of a vehicle door that is hung out of alignment.

These objects are achieved in accordance with the present invention.

BRIEF DESCRIPTION OF THE DRAWINGS

The invention is described below by way of example with reference to a drawing. In the drawing.

DETAILED DESCRIPTION OF THE INVENTION

Figure 1:
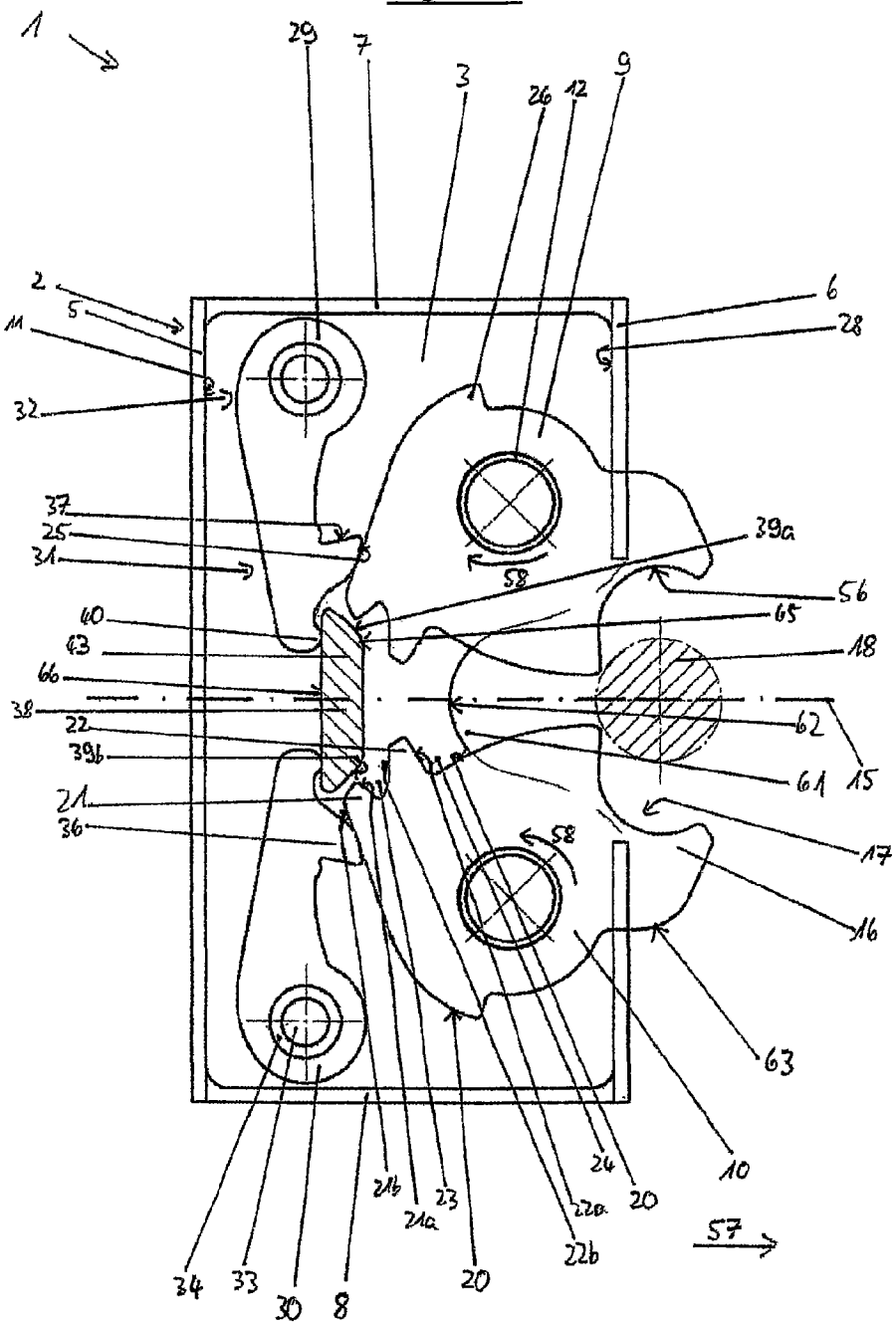
FIG. 1 depicts a longitudinal section of a vehicle door lock in the opened position viewed from the broad side.

The door lock 1 according to one aspect of the invention forms, for the purpose of accommodating the lock mechanism, a rectangular lock case 2 having a smooth base plate or a rear wall 3, a cover or a front wall 4 lying opposite the base plate 3 and running parallel to it, two longitudinal walls 5, 6 parallel to one another and perpendicular to the base plate 3, and two transverse walls 7,8 parallel to one another and perpendicular to the longitudinal walls 5,6 (FIGS. 1-11).

In the lock case 2 and extending all the way through the base plate 3, the cover 4 and the longitudinal wall 6 is a slot-shaped lock pin cut-out recess 61, which provides space to accommodate a door lock pin 18, as explained in greater detail below. The lock pin cut-out recess 61 is formed symmetrically in relation to a transverse central plane 15 of the door lock 1 and extends along the transversal central plane 15 and parallel to the cover 4, viewed from the longitudinal wall 6, into the base plate 3 and the cover 4 and joins a suitably round, and preferably circular base 62 of the cut-out recess. In one view in particular, the lock pin cut-out recess 61 forms perpendicularly to the cover 4, a course which resembles the outline of a bell. The base 62 of the cut-out recess extends preferably for less than half the extent of the cover 4 or the base plate 3 in the direction of the transverse central plane 15 into the cover 4 and the base plate 3.

The lock pin 18 is rigidly attached, preferably by means of a threaded union, to a plate-shaped attachment plate 107 in the customary manner at one end (FIGS. 19-22), in conjunction with which the attachment plate 107 extends perpendicularly to the axis 108 of a lock pin. The purpose of the attachment plate 107 is to provide the attachment, in particular by means of a threaded union, of the lock pin 18 to the vehicle body 109.

Arranged inside the lock case 2 are two rotary latches or rotary latch parts 9 and 10, which are mounted in each case on a preferably hollow cylindrically executed, rotary latch bearing pin 12. The two rotary latch bearing pins 12 are appropriately rigidly connected to the base plate 3 and in each case exhibit a rotary latch bearing pin axis 13, which runs perpendicular to the base plate 3. In addition, the two rotary latch bearing pins 12 are arranged separated from one another in the vicinity of the longitudinal wall 6 exhibiting the lock pin cut-out recess 61 and symmetrically in relation to the transversal central plane 15 of the door lock 1 and are dimensioned in such a way that they pass through the cover 4 and secure the cover 4 and the base plate 3 to one another. Screws, for example, can be pushed through the hollow cylindrical rotary latch bearing pins 12 for this purpose, by means of which screws the lock 1 can be screwed to a door or a door frame (not illustrated).

The rotary latches 9 and 10 mounted on the rotary latch bearing pins 12 are plate-shaped elements, for example plates made of steel, which extend parallel to the base plate 3 and at a small distance from it and preferably have identical physical form. In addition, the rotary latches 9 and 10 are arranged and positioned symmetrically to the transverse central plane 15. Formed on each rotary latch 9 and 10 in each case is a locking nose 16 with a throat 17. The throats 17 of the two rotary latches 9 and 10 are arranged facing towards one another and serve to accommodate the lock pin 18 that extends perpendicularly to the base plate 3 and is executed in a cylindrical manner, as explained in greater detail below. With the lock in an opened position (FIG. 1), the locking noses 16 extend through a slot 19 (FIGS. 7, 11) provided in the longitudinal wall 6 exhibiting the lock pin cut-out recess 61 and extending perpendicularly to the transversal central plane 15 and project laterally beyond the longitudinal wall 6. The slot 19 is also formed symmetrically to the transverse central plane 15 and extends parallel to the base plate 4 and, when viewed from this, projects into the longitudinal wall 6 by rather more than the sum of the thicknesses of the two rotary latches 9 and 10. The slot 19 also forms slot edges 19*a* (FIG. 11), preferably oriented perpendicularly to the base plate 3, which serve as abutment edges in each case for a nose rear wall 63 lying opposite the throat 17 in each case, as explained in greater detail below.

Furthermore, a peripheral wall 20 of the rotary latches 9 and 10 forms two adjacent first and second rotary latch detent noses 21 and 22, which are arranged lying essentially opposite the locking noses 16. The two rotary latch detent noses 21 and 22 in each case forms a short, more rigid flank 21*a* and 22*a* and a long, flatter flank 21*b* and 22*b*, in conjunction with which, viewed in each case against a subsequent locking direction of rotation 58 of the two rotary latches 9 and 10, the short, more rigid flanks 21*a* and 22*a* are arranged after the long, flatter flanks 21 b and 22*b*.

Provided in addition between the two rotary latch detent noses 21 and 22 is a first, appropriately V-shaped detent recess 23, which is of undercut execution as a result of the design of the two flanks 21*a* and 22*b*. A second, similarly appropriately V-shaped rotary latch detent recess 24 is formed by the short flank 22*a* of the second rotary latch detent nose 22 and the peripheral wall 20 connected to the rotary latch detent nose 22. In this case, the short flank 22*a* and the peripheral wall 20 engage with one another preferably more or less at right angles. The bases of the two rotary latch detent recesses 23 and 24 are preferably of rounded form.

Also provided in each case in the peripheral wall 20 is a projection 26, which is appropriately arranged more or less opposite the throat 17. The projections 26 serve to provide support for rotary latch torsion springs or rotary latch spiral springs 27, which are arranged around the rotary latch bearing pins 12 and are supported by a first spring leg 27*a* on the projections 26 and with a second spring leg 27*b* on a longitudinal internal wall 28 of the longitudinal wall 6. The rotary latch springs 27 endeavor to retain the rotary latches 9 and 10 in the opened position (FIG. 1), and in so doing to force apart the locking noses 16 which face towards one another.

Figure 5:
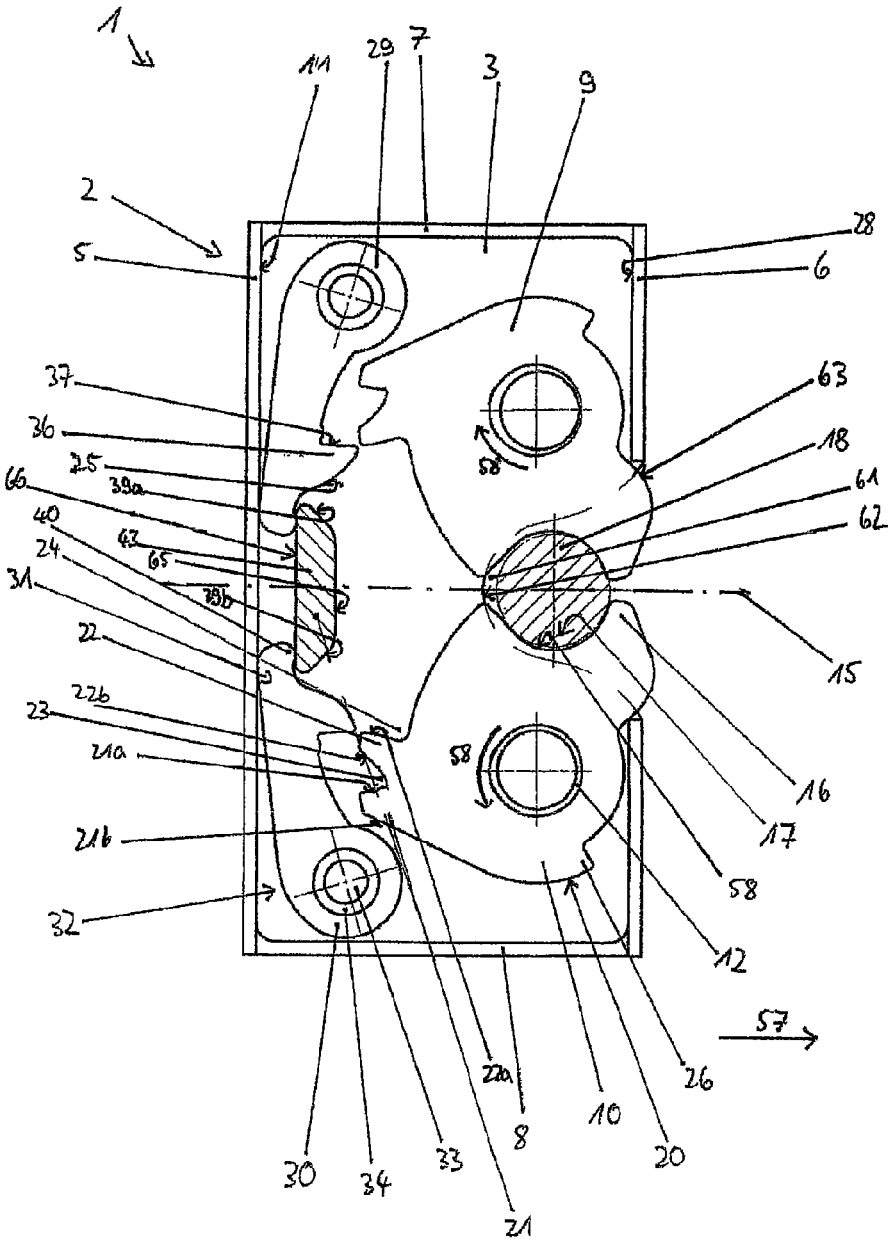
FIG. 5 depicts the vehicle door lock according to FIG. 1 with the locking pawls actuated.
Figure 6:
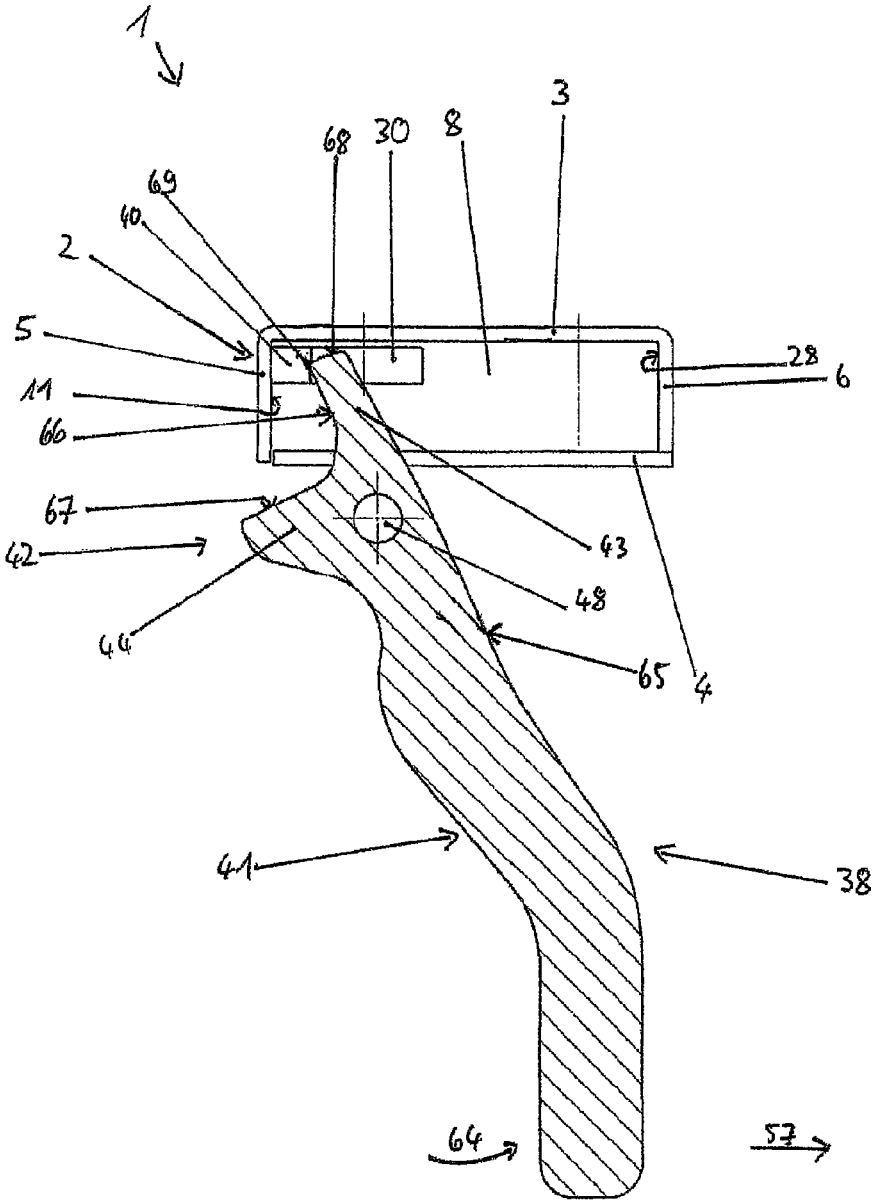
FIG. 6 depicts a cross section through the vehicle door lock according to FIG. 5 along the transversal central plane without rotary latches and lock pins.

For the purpose of actuating the two rotary latches 9 and 10, the door lock 1 according to the invention exhibits two detent levers or locking pawls 29 and 30, which retain the rotary latches 9 and 10 in a closed position (FIG. 3) or in a preloaded position (FIG. 2) or release the two rotary latches 9 and 10 (FIGS. 1, 5). The two locking pawls 29 and 30 are also plate-shaped, for example made of steel, and are formed so as to extend parallel to the base plate 3, and in addition has an essentially elongated and are preferably of identical physical form, in conjunction with which in each case a pawl actuating section 31 is provided at one end and a bearing section 32 is provided at the other end. The bearing section 32 in each case exhibits a transcurrent bore 33, by means of which the locking pawls 29 and 30 are mounted in such a way as to be capable of rotating on preferably hollow cylindrical pawl bearing pins 34. In this case, the two pawl bearing pins 34 are appropriately also rigidly connected to the base plate 3 and each define a bearing pin axis 35, which is oriented perpendicularly to the base plate 3. In addition, the two pawl bearing pins 34 are arranged at a certain distance from one another symmetrically in relation to the transversal central plane 15 of the door lock 1 and in each case in corner areas formed by the transversal walls 7 and 8 and the longitudinal wall 5, so that the locking pawls 29 and 30 are also formed and arranged symmetrically to the transverse central plane 15.

The pawl bearing pins 34 are also dimensioned in such a way that they extend through the cover 4 and connect the cover 4 and the base plate 3 to one another. It is also possible, on the other hand, to push screws through the hollow cylindrical pawl bearing pins 34, by means of which screws the lock can be screwed to a door or a door frame (not illustrated).

The pawl actuating section 31 of the two locking pawls 29 and 30 in each case form an adjoining pawl detent nose 36, which is formed facing towards the rotary latches 9 and 10 and is executed essentially in the manner of a saw tooth having a short, rigid and preferably rectilinear pawl detent nose flank 37 facing towards the bearing section 32 and a longer and less rigid pawl detent nose flank 25. The longer pawl detent nose flank 25 is also of rounded form, so that it is flattened in relation to the short, rigid pawl detent nose flank 37.

Figure 3:
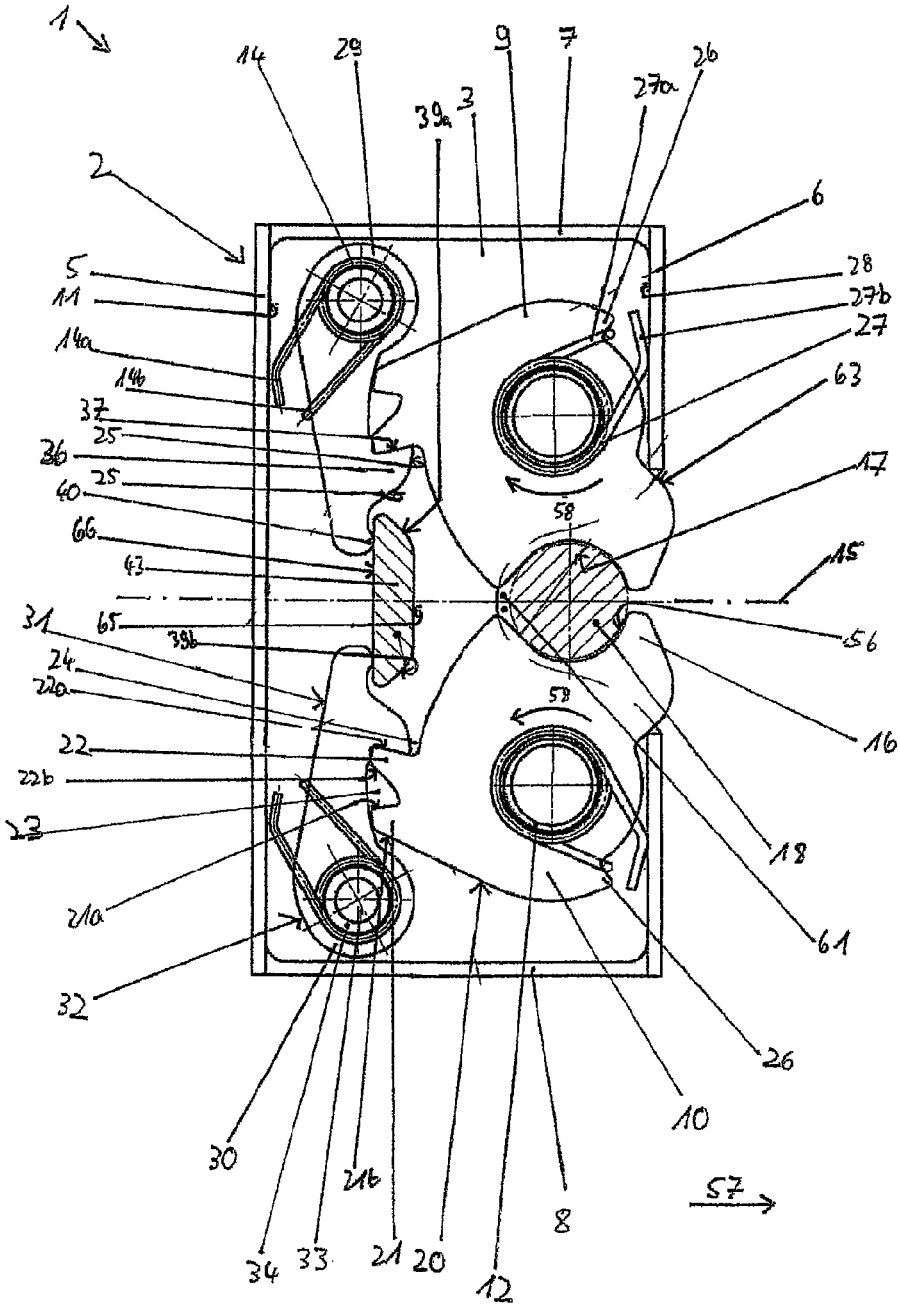
FIG. 3 depicts the vehicle door lock according to FIG. 1 in the closed position.
Figure 4:
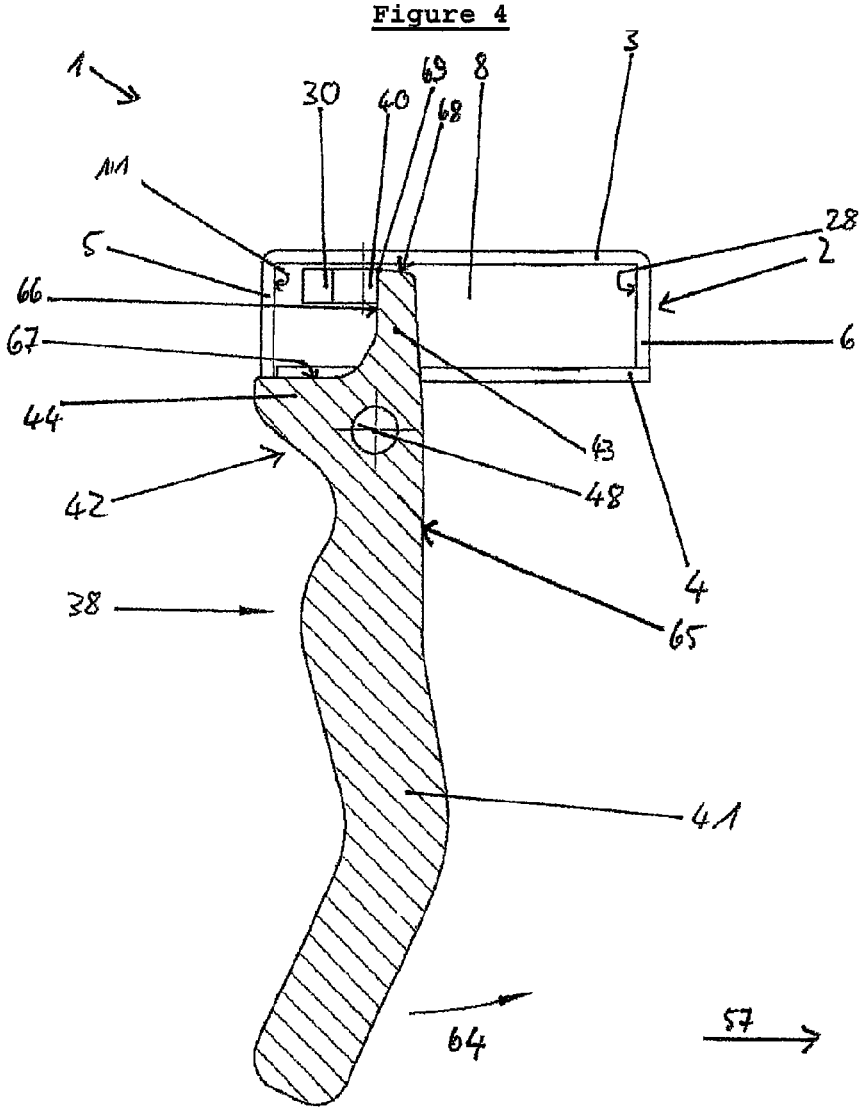
FIG. 4 depicts a cross section through the vehicle door lock according to FIG. 3 along a transversal central plane without rotary latches and lock pins.

In addition, the locking pawls 29 and 30 are arranged with spring loading in such a way that their pawl actuating sections 31 arranged lying opposite one another are pressed in the direction of the rotary latches 9 and 10 or against these. Provided for this purpose in each case is a pawl torsion spring 14, for example, which springs are arranged around the pawl bearing pins 34 and are supported with one spring leg 14*a* on a longitudinal inner wall 11 of the longitudinal wall 5 and with the other spring leg 14*b* on the locking pawls 29 and 30 themselves (FIG. 3). Provided in each case as an alternative is a compression spring, which is also supported on the inner wall 11 of the longitudinal wall 5 and on the locking pawls 29 and 30 themselves, for example in the vicinity of the pawl actuating section 31 (not illustrated).

An actuating projection or a supporting projection 40 is provided in each case at the end of the locking pawls 29 and 30 on the actuating section side, which projection also extends in the direction of the rotary latches 9 and 10. This actuating projection 40 serves as a support for an actuating lever 38, with which the locking pawls 29 and 30 are caused to rotate about the pawl bearing pins 34.

This actuating lever 38 is also a preferably plate-shaped element, of which the mutually parallel lever side walls 39*a* and 39*b* are perpendicular to the base plate 3 of the lock case 2. In addition, the actuating lever 38 consists essentially of a grip part 41, which exhibits an essentially elongated course, and an adjoining lever actuating section 42 at one end of the grip part 41. The grip part 41 serves for gripping and operating or pivoting the actuating lever 38 by an operating person, as explained in greater detail below, and is of an appropriately ergonomic design in this respect.

The lever actuating section 42 exhibits an adjoining actuating nose 43 as an extension to the grip part 41 and a support nose or abutment nose 44 adjoining the actuating nose 43 in an essentially perpendicular manner in the transitional zone between the grip part 41 and the lever actuating section 42. A preferably smooth actuating surface 66 of the actuating nose 43 facing away from a front side 65 of the lever in this case appropriately subtends a right angle with a similarly preferably smooth abutment surface or support surface 67 facing towards the actuating nose 43. Furthermore, the actuating nose 43 exhibits an actuating end surface 68, which blends into the actuating surface 66 via an actuating edge 69.

The end of the actuating nose 43 facing away from the grip part 41 is preferably of slightly broadened form in addition with a trapezoidal cross section (FIGS. 1-3, 5, 11), so that the side walls 39*a* and 39*b* are no longer parallel with one another in this area.

Figure 7:
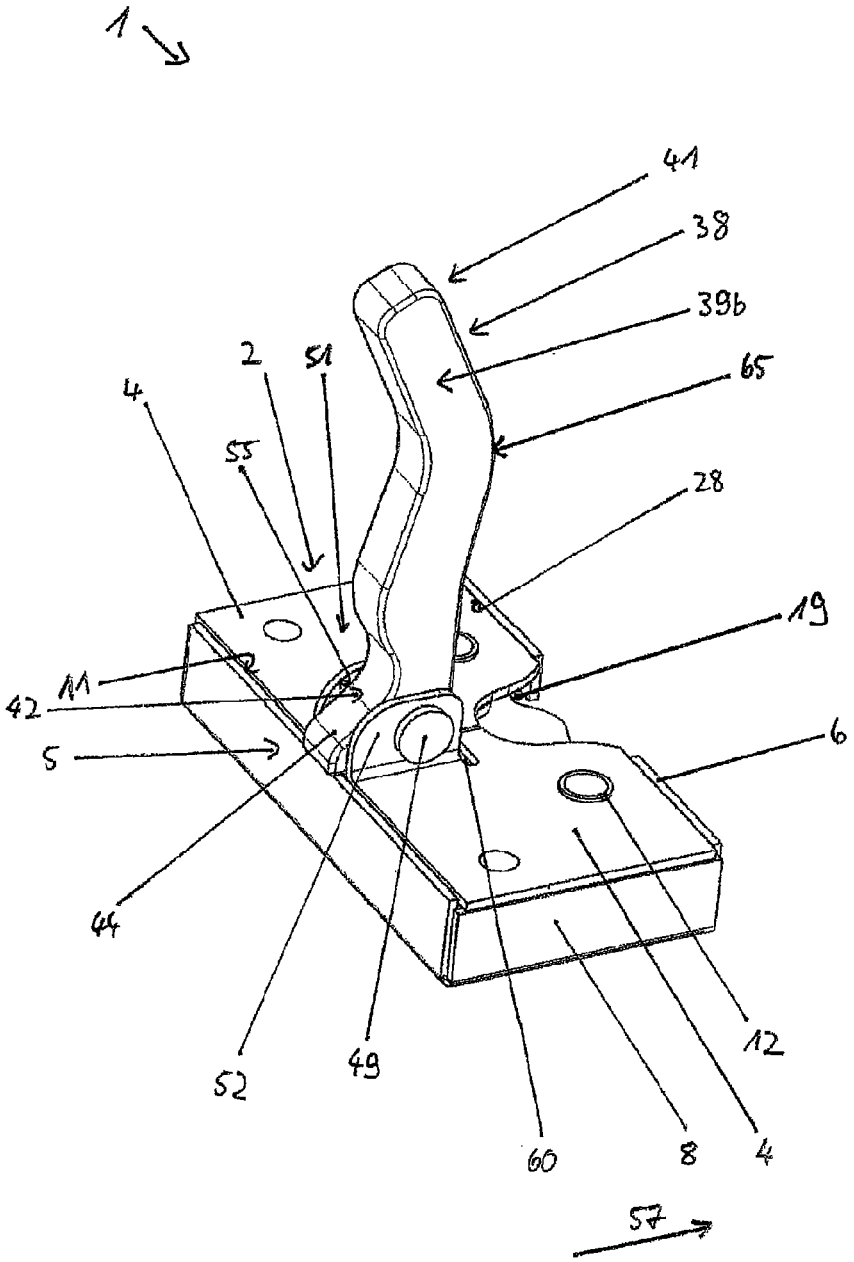
FIG. 7 depicts a perspective view of the vehicle door lock according to the invention viewed from the lever side.
Figure 8:
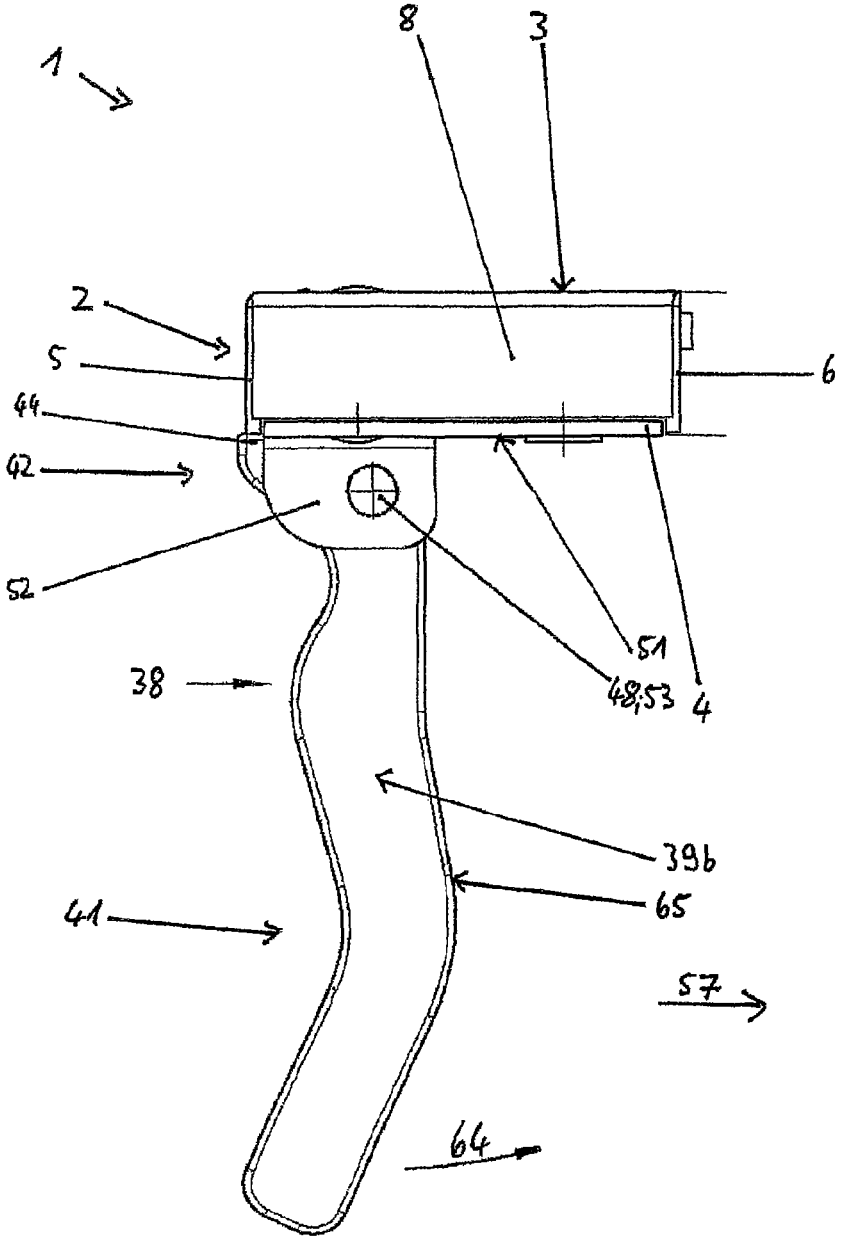
FIG. 8 depicts an end view of the vehicle door lock according to FIG. 7.
Figure 9:
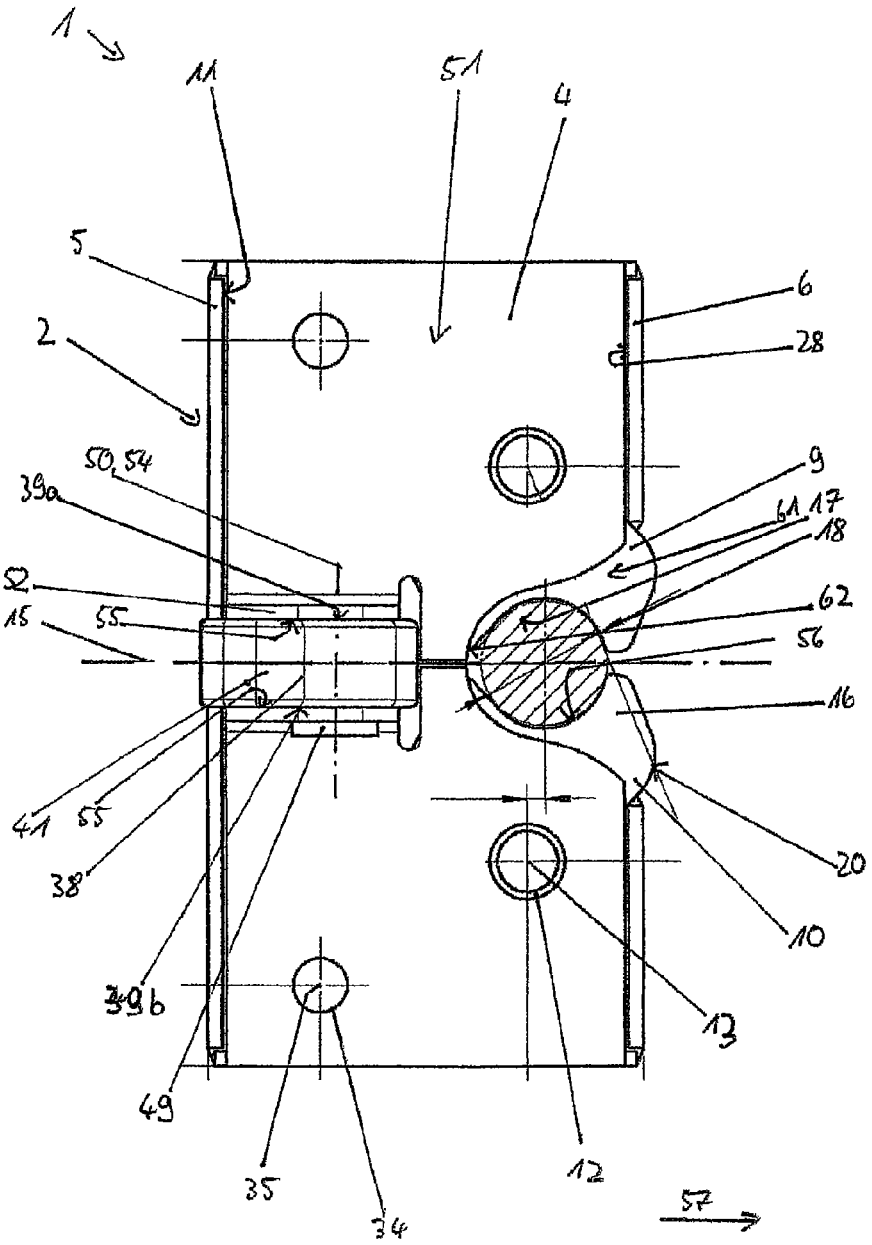
FIG. 9 depicts a top view of the vehicle door lock according to FIG. 7 viewed from the broad side.
Figure 10:
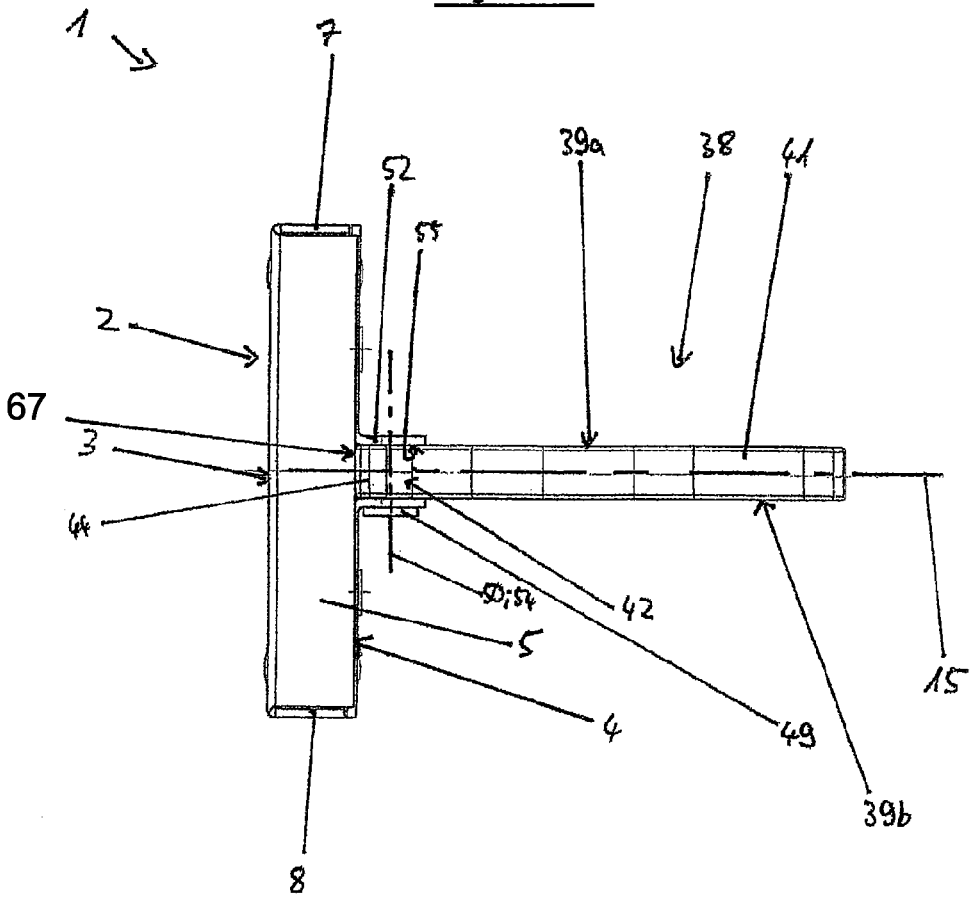
FIG. 10 depicts a view of the vehicle door lock according to FIG. 7 viewed from the narrow side.
Figure 11:
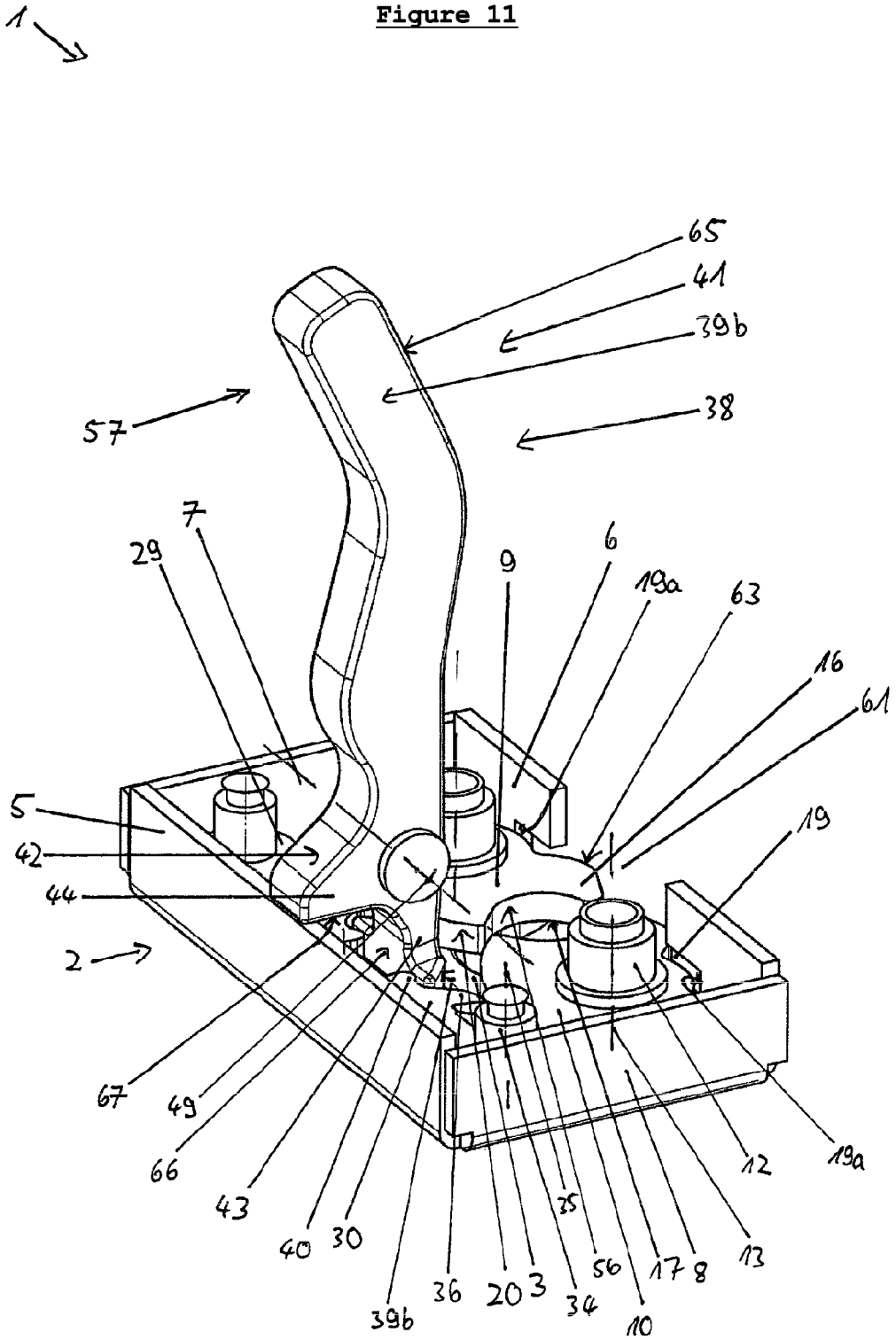
FIG. 11 depicts a perspective view of the vehicle door lock according to the invention viewed from the lever side without a cover for a lock case.
Figure 12:
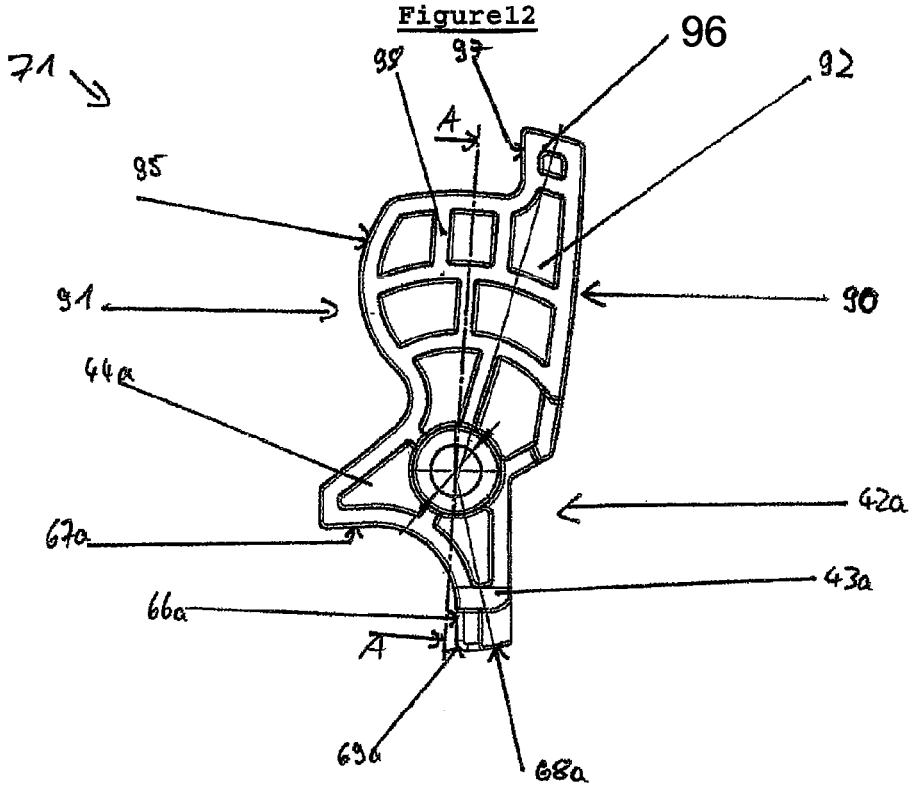
FIG. 12 depicts a side view of a push-button lever for a further embodiment of the actuating lever.

Provided in the vicinity of the lever actuating section 42, furthermore, is a lever bearing bore 48, arranged in which is a lever bearing pin 49 or the like, preferably in the form of a collar, having a lever bearing pin axis 50, which is oriented perpendicular to the side walls 39*a* and 39*b* of the lever. The actuating lever 38 is connected to the cover 4 of the lock case 2 in such a way that it is capable of rotating by means of the lever bearing pin 49. Adjoining an external wall 51 of the cover for this purpose are two mutually parallel lobes 52, which are oriented perpendicularly to the cover 4 and parallel to the transversal walls 7 and 8 and, in each case, exhibit a cylindrical, lever bearing cut-out recess 53. In addition, the lobes 52 are arranged symmetrically to the transverse central plane 15. The lever bearing pin 49 is arranged in the lever bearing cut-out recesses 53, of which the lever bearing cut-out axes 54 run parallel to the cover 4 and the longitudinal walls 5 and 6. In conjunction with this, lobe internal walls 55 facing one another are appropriately separated from one another by the same amount as the side walls 39*a* and 39*b* of the lever, so that the actuating lever 38 is arranged between the lobes 52 and makes sliding contact with them. Preferably a torsion spring or the like is also provided (not illustrated), which presses the actuating lever 38 with its abutment surface 67 against the outside 51 of the cover and/or an outer edge of the longitudinal wall 5 located on the cover side (FIG. 7).

Furthermore, the cover 4 is grooved between the mutually opposite lobes 52, so that a passage opening 60 (FIG. 7) is formed, which is dimensioned in such a way that the actuating nose 36 of the actuating lever 38 passes through it and the actuating lever 38 can undergo its pivoting movement unhindered.

A two-part actuating lever 38*a* is proposed according to a further embodiment of the invention (FIGS. 12-18). The actuating lever 38*a* consists of a handle lever 70 for gripping and actuating the door lock 1 from the interior of the vehicle, and a push-button lever 71 for actuating the door lock 1 from the outside by means of an appropriate actuating mechanism, for example by a push-button of an already familiar kind (not illustrated.

The handle lever 70 (FIGS. 15-17) exhibits an ergonomically formed handle 72. As an extension of the handle 72, the handle lever 70 exhibits an adjoining end 74, which serves to receive the push-button lever 71 between two preferably plate-shaped fork arms 75. For this purpose, the distance between mutually parallel fork internal surfaces 76, which are oriented perpendicularly to the base plate 3 in the installed state, corresponds to the width of the push-button lever 71, as explained in greater detail below. At their ends, each of the two fork arms 75 exhibit an adjoining handle lever support nose or abutment nose 77, which extend essentially perpendicularly to the rest of the longitudinal extent of the fork arms 75 and away from the rear side 78 of a fork arm. Each of the handle lever support noses or abutment noses 77 exhibits a preferably smooth handle lever abutment surface and supporting surface 79 facing away from the handle 72.

Figure 17:
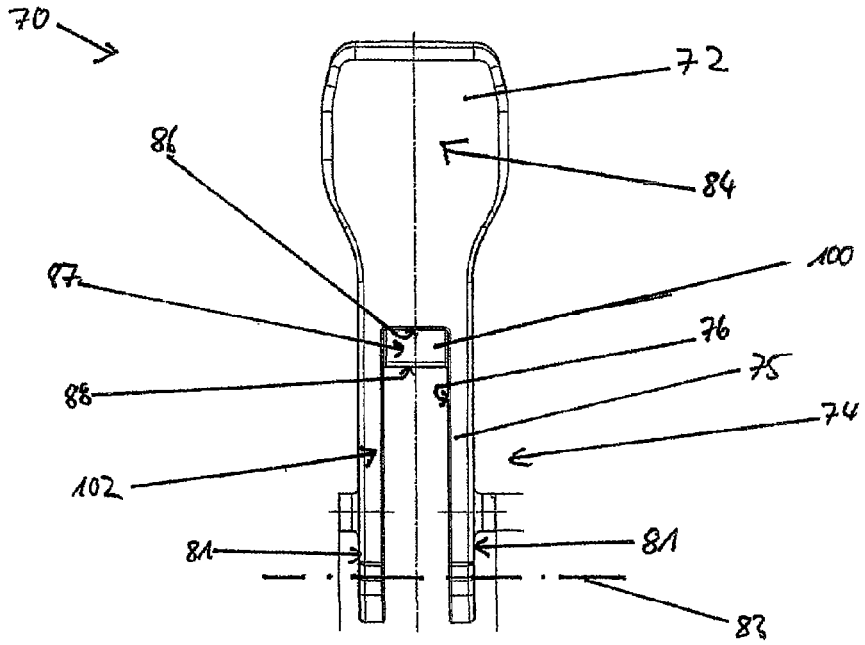
FIG. 17 depicts a front view of the handle lever.
Figure 18:
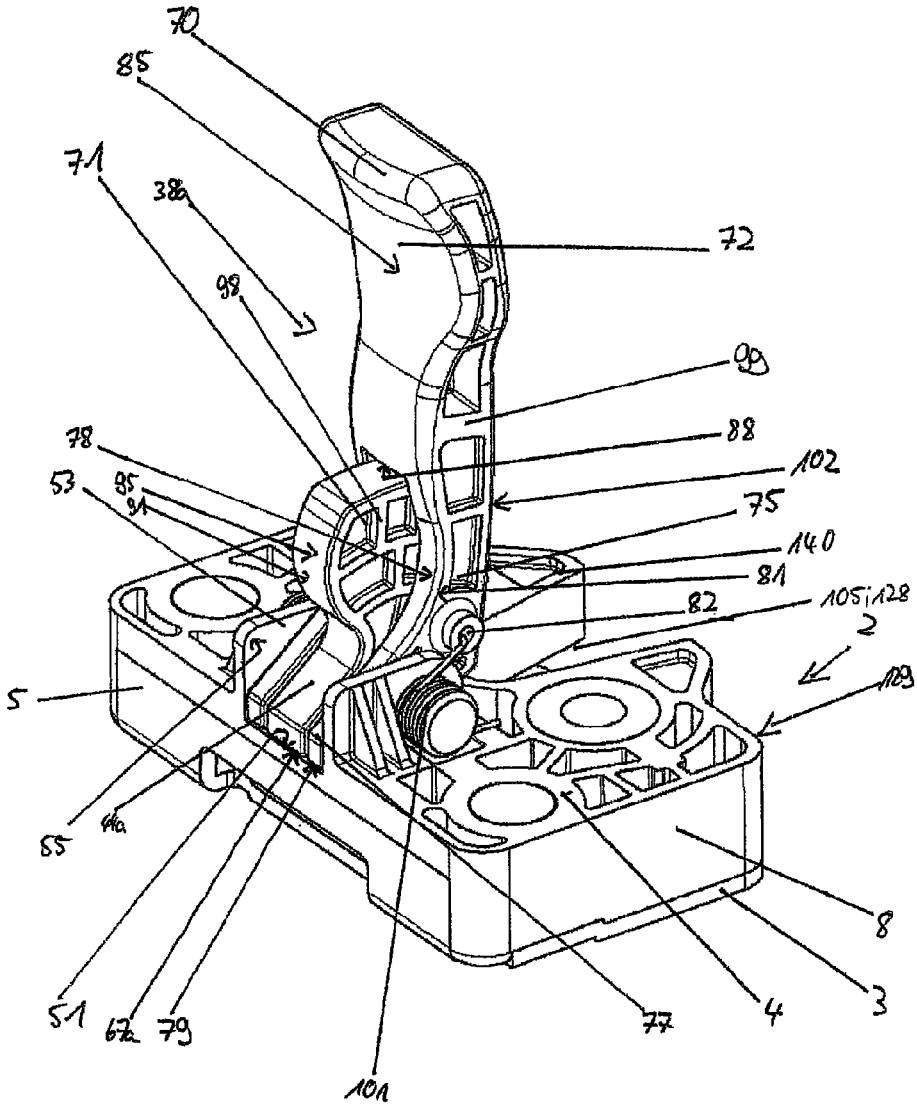
FIG. 18 depicts a perspective view of a further embodiment of a vehicle door lock according to the invention viewed from the lever side.

Furthermore, the handle lever 70 exhibits a handle lever bearing bore 80 in the vicinity of the handle lever support nose or abutment nose 77 for accommodating the lever bearing pin 49, which bore passes from one external surface 81 of the fork to the opposing and appropriately parallel external surface 81 of the fork, that is to say through both fork arms 75, and the handle lever bearing bore axis 83 of which is perpendicular to the internal surfaces 76 of the fork (FIG. 17).

Furthermore, a torsion spring leg receiving bore 82 is provided, which passes through the fork arm 75 in each case, in conjunction with which the two torsion spring leg receiving bores 82 are preferably arranged in alignment in the direction of the handle lever bearing bore axis 83.

In the transitional area between the handle 72 and the fork end 74, the handle lever 70 exhibits in addition a carrier step and an abutment step 100, which, when viewed from the front side 84 of a handle lever, initially comprises a first stepped edge 86 extending essentially from a front side 84 of the handle lever in the direction of a rear side 85 of the handle lever and perpendicular to the internal surfaces 76 of the fork, a stepped base 87 extending perpendicularly to the internal surfaces 76 of the fork and essentially as far as the first stepped edge 86, which stepped base extends away from the first stepped edge 86 in the direction of the handle lever support nose or abutment nose 77, and a second stepped edge 88 extending essentially perpendicularly to the stepped base 87 as far as the rear side 85 of the handle lever and perpendicular to the internal surfaces 76 of the fork.

The push-button lever 71 (FIGS. 12-14) is of essentially plate-shape form and has two push-button lever lateral surfaces 89 parallel to one another, one push-button lever front side 90 and lying opposite this one push-button lever rear side 91. The push-button lever 71 consists essentially of a push-button part 92 and a push-button lever actuating section 42*a* adjoining this at one end.

The push-button lever actuating section 42*a* also forms, similarly to the lever actuating section 42 of the one-piece actuating lever 38, an actuating nose 43*a* and a supporting nose or an abutment nose 44*a* connected to the actuating nose 43*a* essentially at right angles in the transitional zone of the button 92 for the lever actuating section 42*a*. In this case, a preferably smooth actuating surface 66*a* of the actuating nose 43*a* facing away from the front side 90 of the push-button lever also appropriately subtends a right angle with a similarly preferably smooth support surface 67*a* facing towards the actuating nose 43*a*. Furthermore, the actuating nose 43*a* of the push-button lever 71 also forms an actuating end surface 68*a*, which blends into the actuating surface 66*a* via an actuating edge 69*a*.

Figure 13:
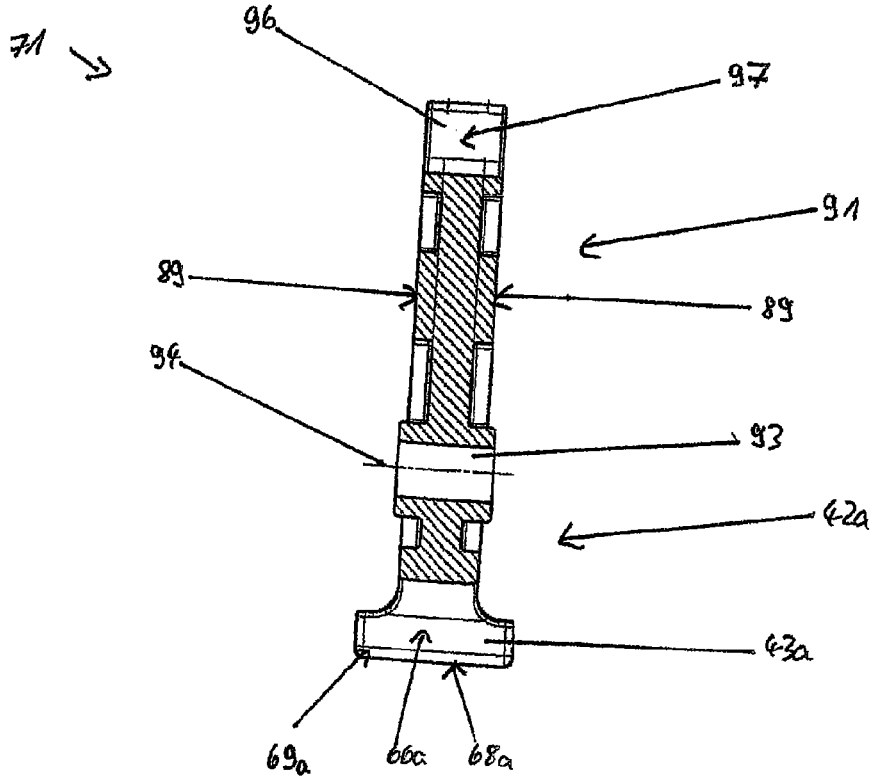
FIG. 13 depicts a longitudinal section through the push-button lever according to FIG. 12 along the line A-A.
Figure 14:
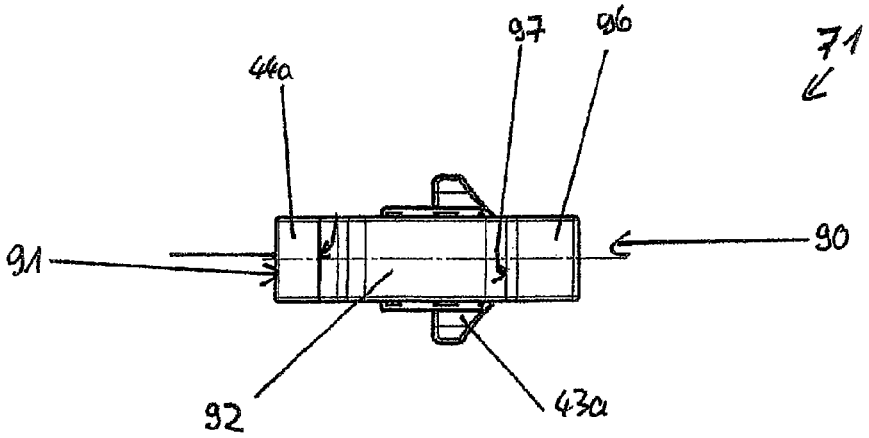
FIG. 14 depicts a view of the push-button lever according to FIG. 12 viewed from the button component side.
Figure 15:
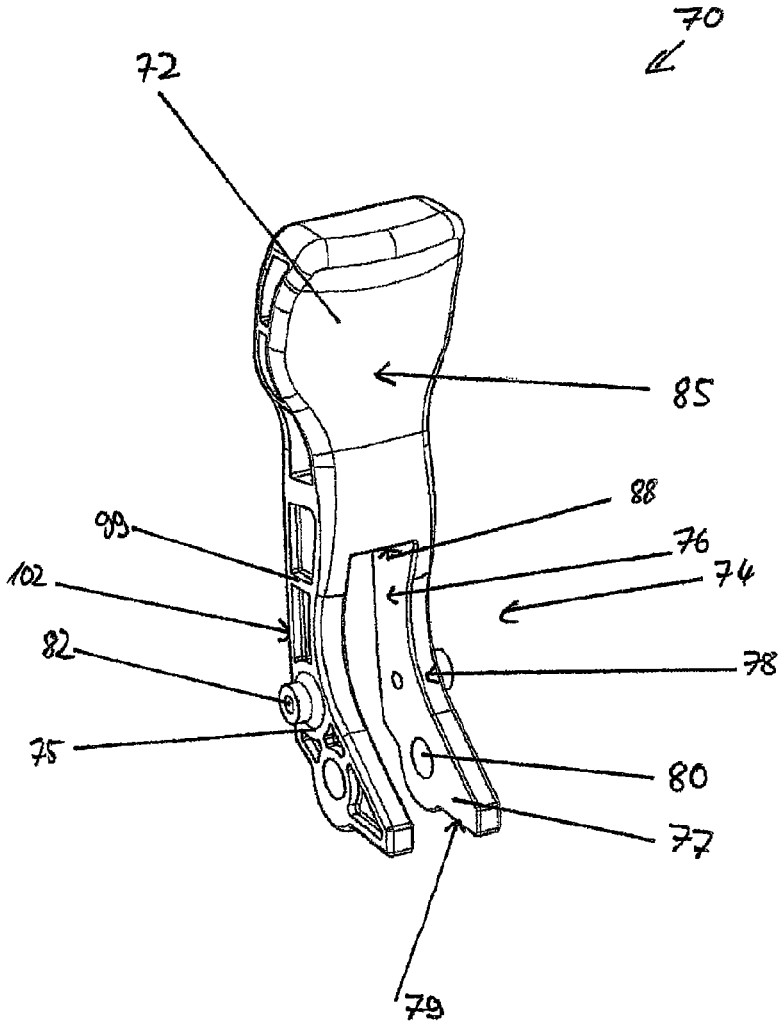
FIG. 15 depicts a perspective view of a handle lever for the further embodiment of the actuating lever.

The end of the actuating nose 43*a* is preferably also of slightly broadened form in addition (FIGS. 13, 14).

Furthermore, in the area of the push-button lever actuating section 42*a*, a push-button lever bearing bore 93 is provided to accommodate the lever bearing pin 49, in conjunction with which a lever bearing pin axis 94 is oriented perpendicularly to the lateral surfaces 89 of the push-button lever.

For the purpose of actuating the push-button lever 71, the rear side 91 of the push-button lever also forms in the area of the push-button part 92 an appropriately concave, arched pressure surface 95, which serves as an actuating surface for the push-button.

At its end lying opposite the actuating section 42*a*, the pressure part also exhibits an adjoining carrier and abutment projection 96, which forms a preferably smooth carrier and abutment surface 97 on the rear, which is appropriately oriented essentially parallel to the front side 90 of the push-button lever.

For the purpose of stiffening, both the handle lever 70 and the push-button lever 71 appropriately exhibit stiffening ribs 98 and 99.

With the two-part actuating lever 38*a* in its assembled and installed, but not actuated, state (FIG. 18), the push-button lever 71 is arranged inside the two fork arms 75 of the handle lever 70, in conjunction with which the lever bearing pin 49 is introduced both into the push-button lever bearing bore 93 and into the handle lever bearing bore 80. In addition, the lever bearing pin 49 is supported in the lever bearing cut-out recess 53 of the lobes 52, so that the push-button lever 71 and the handle lever 70 are both in connection with the cover 4 of the lock case 2 in such a way that they are able to rotate about the axis 50 of the lever bearing pin. In this case, internal walls 55 of the bores facing towards one another are appropriately separated from one another by the same amount as the external surfaces 81 of the fork of the handle lever 70, so that the two-part actuating lever 38*a* is also arranged between the lobes 52 and is in sliding contact with these and is arranged so that it is incapable of being displaced in the direction of the lever bearing pin axis 50.

Provided in addition is a torsion spring 101, which presses the handle lever 70 with its handle lever abutment surfaces 79 against the outside 51 of the cover (FIG. 18) and/or an outside edge of the longitudinal wall 5 on the cover side (not illustrated). In addition, the push-button lever 71 is arranged and dimensioned in such a way that the carrier surface and abutment surface 97 of the push-button lever 71 is in contact with the stepped base 87 of the carrier step and abutment step 100 (not illustrated). And the actuating surface 66*a* of the push-button lever 71 rests on the rounded supporting projections 40 of the locking pawls 29 and 30. By this means, and preferably by means of a further torsion spring that is not illustrated here, the push-button lever 71 with its push-button lever abutment surface 67*a* is also pressed against the outside 51 of the cover and/or an outer edge of the longitudinal wall 5 on the cover side. In this case, the pressure surface 95 of the push-button lever 71 is appropriately not arranged between the fork arms 75, but projects between them at the rear, since the distance from the front side 90 of the push-button lever to the rear side 91 of the push-button lever in the area of the pressure surface 95 is greater than the distance of a front side 102 of the fork arm to the rear side 78 of the fork arm. In addition, the front sides 102 of the fork arm are formed and arranged in such a way that they are in alignment in a direction perpendicular to the internal fork surfaces 76 of the front side 90 of the push-button lever.

The mode of operation and the actuation of the door lock 1 according to the invention are explained in greater detail below initially with reference to the one-part actuating lever 38:

With the door lock 1 in an opened position, the lock pin 18 is located outside the lock case 2 between the throats 17 of the two rotary latches 9 and 10. The locking noses 16 extend through the slot 19 and are pressed by the force of the rotary latch torsion springs 27 with their locking nose rear walls 63 against the slot edges 19*a* serving as an abutment and perpendicular to the base plate 3. Furthermore, the locking pawls 29 and 30 are subjected to the pressure exerted by the pawl torsion springs 14 with their flat pawl detent nose flanks 25 on the long, flatter flanks 21*b* of the first detent recesses 23 and 24. The actuating lever 38 is in contact under spring loading, with the door lock 1 according to the invention in its opened position, with its abutment surface 67 against the outside 51 of the cover and/or the outer edge of the longitudinal wall 5 located on the cover side (FIG. 7) and with its actuating surface 66 on the rounded supporting projections 40 of the locking pawls 29 and 30.

Figure 2:
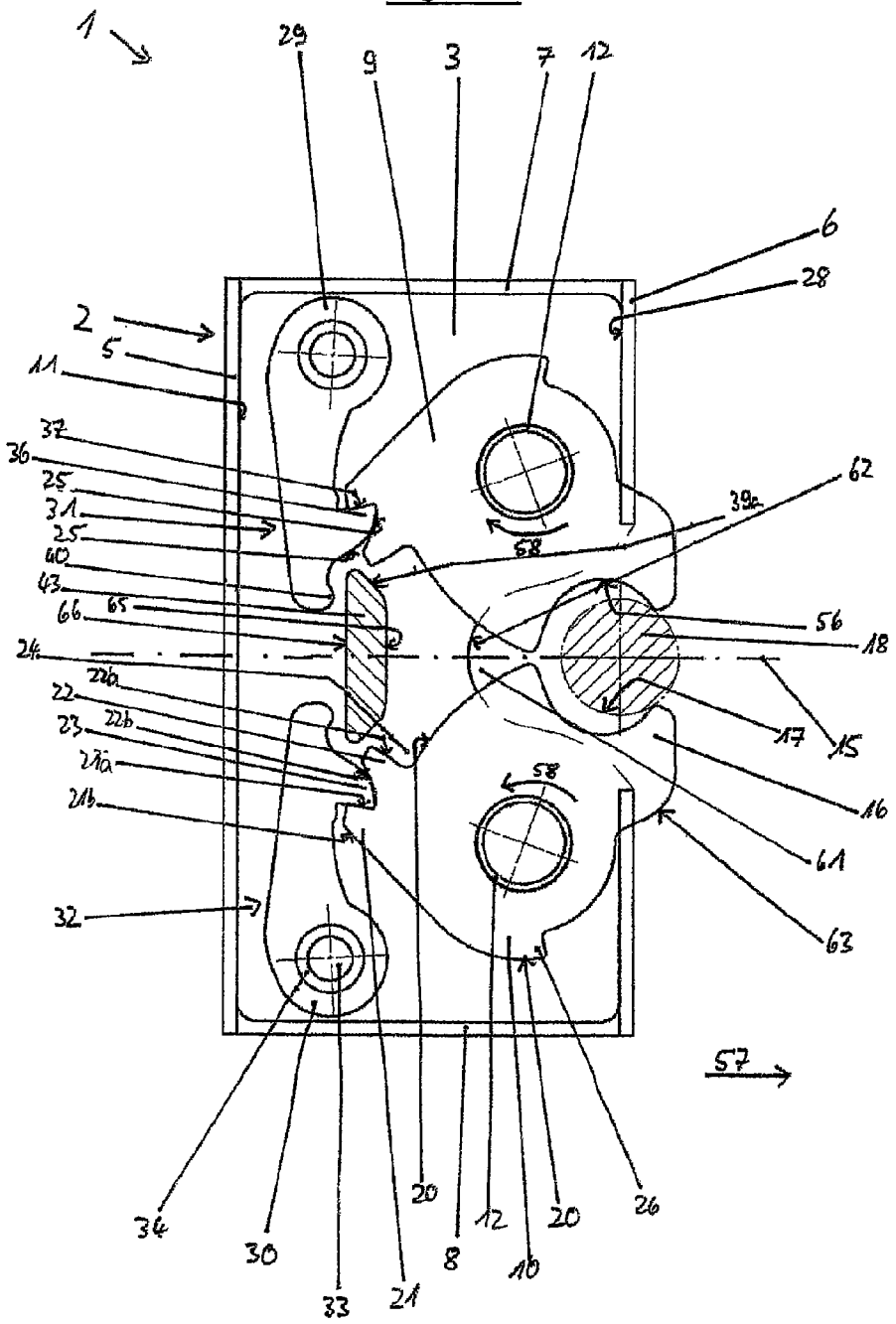
FIG. 2 depicts the vehicle door lock according to FIG. 1 in the preloaded position.

If the door is closed, the lock pin 18 presses against a door closing direction (arrow 57) against throat walls 56 of the rotary latches 9 and 10, and the rotary latches 9 and 10 are caused to pivot against the pressure of the rotary latch springs 27 and, to some extent, that of the pawl torsion springs 14 in the direction of closing 58, in the opposite direction around the hollow cylindrical rotary latch bearing pins 12, so that the locking noses 16 are caused to move towards one another and partially to enclose the lock pins 18, in conjunction with which the locking noses 16 are then present with the lock pin 18 located partially inside the lock pin cut-out recess 61 of the lock case 2 (FIG. 2). The rotating movement also causes the first detent recesses 23 in each case to arrive in the vicinity of the pawl detent nose 36 that is subjected to spring pressure, which, as soon as the distance is sufficiently large in each case between the first detent recesses 23 of the two rotary latches 9 and 10, arrive in the first detent recess 23 in each case and engage there under the effect of the spring pressure of the pawl torsion springs 14 (safety catch position). In this position, the rigid, short pawl detent nose flanks 37 are in contact with the short, undercut flanks 21 a of the first rotary latch detent noses 21, and in particular with positive engagement, so that the two rotary latches 9 and 10 are locked and can no longer be caused to rotate by the force of the rotary latch torsion springs 27 in the opposite direction to the locking direction of rotation 58. In conjunction with this, the locking noses 16 are arranged so that they mesh together to such an extent that the lock pin 18 is no longer capable of escaping from the area between the throats 17, and the door lock 1 is only capable of moving by a specific amount in the door closing direction 57. The actuating lever 38 in this case remains under spring loading in its previous position. Because the locking pawls 29 and 30 are rather further away from the rotary latches 9 and 10 than in the opened position of the door lock 1, however, the actuating lever 38 is no longer supported with its actuating surface 66 on the supporting projections 40.

If the rotary latches 9 and 10 are caused to rotate further in the closing direction 58 by the pressure of the lock pin 18 on the throat walls 56, the flat pawl detent nose flanks 25 will slide along the flat, long flanks 22*b* of the second rotary latch detent noses 21 until the pawl detent noses 36 arrive in the second detent recesses 24 of the rotary latches 9 and 10 in each case and engage there under the effect of the spring force of the pawl torsion springs 14. The rotary latches 9 and 10 are then in a completely closed position (FIGS. 3 and 4), in conjunction with which the door lock pin 18 is arranged in positive engagement in the throats 17 and as such is securely gripped by the rotary latches 9 and 10. In this position, the rigid, short pawl detent nose flanks 37 are in contact with the short, undercut flanks 22*a* of the second rotary latch detent noses 22, and in particular with positive engagement, so that the two rotary latches 9 and 10 are again locked and are no longer capable of being caused to rotate by the force of the rotary latch torsion springs 27 in the opposite direction to the locking direction of rotation 58. The lock 1 is retained in the closed position in this way. In the closed position, the actuating lever 38 is again appropriately supported with its actuating surface 66 on the supporting projections 40.

In order to open the door lock 1 according to the invention from the pre-engaged safety catch position (FIG. 2) or from the locked position (FIGS. 3, 4), the actuating lever 38 is actuated by causing it to pivot, for example against the force of the spring (not illustrated here), in the direction of rotation 64 of the lever about the lever bearing pin 49, so that the grip part 41 is displaced in the direction of the rotary latches 9 and 10 and the lever actuating section 42 is displaced away from the rotary latches 9 and 10. This takes place, for example from the interior of a vehicle, by pulling on the grip part 41 of the single-part actuating lever 38, or from the outside in a previously disclosed manner by pushing a push-button, which interacts operatively with the actuating lever 38 and causes this to pivot (not illustrated). In this case, the supporting projections 40 are carried in positive engagement via the adjacent actuating surfaces 66 or under the effect of the rotation of the actuating lever 38 via the actuating edges 69, from the actuating noses 43 of the lever actuating section 42, and in this way the locking pawls 29 and 30 are caused to rotate about the pawl bearing pins 34 to such an extent against the pressure of the pawl torsion springs 14 and because of the undercut design of the rotary latch detent noses 21 and 22 against the pressure of the rotary latch springs 27, until the pawl detent noses 36 have been forced completely out of the first and second detent recesses 23 and 24. The rotary latches 9 and 10 then snap back into engagement, under the effect of the pressure of the rotary latch springs 27, into their opened starting position (FIG. 1) until the nose rear walls 63 abut against the slot edges 19*a* of the slot 19. The lock pin 18 is forced out of the lock case 1 by the throat walls 56. After releasing the actuating lever 38, this also snaps back appropriately into its starting position (FIGS. 1, 4) under the effect of the pressure of the spring (not illustrated here).

Figure 16:
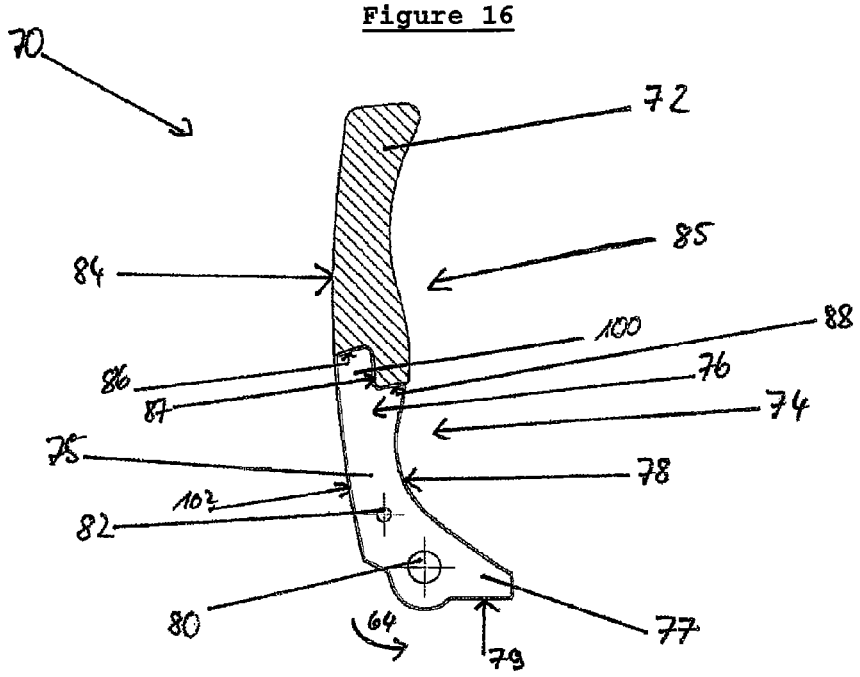
FIG. 16 depicts a longitudinal section through the handle lever.

In the embodiment of the door lock 1 with the two-part actuating lever 38*a*, the actuation of the locking pawls 29 and 30 takes place as follows:

If the door lock 1 is operated from the interior of the vehicle, this involves pulling on the handle 72 of the handle lever 70 in a similar manner to that already described above, and causing this to pivot about the lever bearing pin 49 against the force of the torsion spring 101 in the direction of rotation 64*a* of the lever (FIG. 16). At the same time, the push-button lever 71, of which the carrier projection 96 makes contact with the stepped base 87 of the handle lever 70, is carried by the handle lever 70 and is also caused to pivot about the lever bearing pin 49 without delay in the direction of rotation 64 of the lever. At the same time, as already described above, the supporting projections 40 above the adjacent actuating surfaces 66*a* of the push-button lever and under the effect of the rotation of the push-button lever 71 via the actuating edge 69*a,* are carried with positive engagement by the actuating noses 43*a* of the push-button lever actuating section 42*a,* as a result of which the locking pawls 29 and 30 are caused to rotate about the pawl bearing pins 34 against the pressure of the rotary latch springs 27 and, through the effect of the undercut design of the rotary latch detent noses 21 and 22, against the pressure of the pawl torsion springs 14.

After releasing the handle lever 70, this snaps back into its starting position under the effect of the pressure of the torsion spring 101. The push-button lever is also caused to pivot back into its starting position by the torsion spring (not illustrated) against the direction of rotation of the lever, until it abuts against the stepped base once again with its carrier surface and abutment surface.

The handle lever and the push-button lever thus interact operatively with one another in such a way that the rotating movement of the handle lever in the direction of rotation 64 of the lever is transmitted to the push-button lever, in particular without delay. The rotating movement of the handle lever against the direction of rotation 64 of the lever is not capable of being transmitted to the push-button lever.

If the door lock 1 is operated from the outside, an actuating element (not illustrated here), for example a push-button of a previously disclosed kind (not illustrated here) presses on the pressure surface of the push-button lever in the direction of closing 57 of the door, so that the push-button lever is caused to pivot about the lever bearing in 49 once again in the direction of rotation 64*a* of the lever and in this way actuates the locking pawls. Since the carrier surface and abutment surface is lifted from the stepped base of the handle lever 70 at the same time, the handle lever 70 is not actuated by the push-button and is also not carried by the push-button lever 71. The handle lever 70 is retained in its non-actuated position (FIG. 18) by the torsion spring 101. Thus, only the push-button lever 71 interacts operatively with the push-button.

After retracting the actuating element of the push-button, the push-button lever 71 is caused to pivot back into its starting position, as already described above, under the effect of the force of the pawl torsion springs 14 or the torsion springs (not illustrated here).

It also falls within the scope of the invention, of course, to propose two actuating levers 38 for operating the locking pawls 29 and 30.

In order to minimize the forces which act upon the lock pin 18 and the lock pin cut-out recess 61 in the lock case 2, and partially on the rotary latches 9 and 10, in conjunction with the closing and opening of a vehicle door that is hung out of alignment, the invention provides for a supplementary location, centering and guide device for the purpose of locating, centering and guiding the vehicle door in relation to the body during opening and closing of the vehicle door. This location, centering and guide device exhibits a location, centering and guide element 104 with positive form, which is securely connected to the vehicle body 109, and in particular to the lock pin 18, and which interacts with a corresponding location, centering and guide element 105 with the corresponding negative form in conjunction with closing and opening the vehicle door, which element is securely connected to the vehicle door, and in particular to the lock case 2.

At the same time, it also falls within the scope of the invention, of course, to invert the connection of the two elements 104 and 105 to the vehicle body 109 and to the vehicle door.

In the case of the location, centering and guide element 104 connected to the lock pin 18, the item in question is a plate-shaped location, centering and guide wedge 106, which is arranged on an end face 110 of the lock pin 18 lying opposite the attachment plate 107. At the same time, the location, centering and guide wedge 106 exhibits a preferably smooth wedge rear side 111 facing towards the attachment plate 107, a wedge front side 112 appropriately parallel and opposite thereto, and perpendicular thereto a wedge peripheral wall 113. The wedge front side 112 and the wedge rear side 111 are preferably oriented perpendicularly to the axis 108 of the lock pin in this case.

To provide the wedge form, the peripheral wall 113 of the wedge exhibits, in one view seen in the direction of the axis 108 of the lock pin, a conical course with two mutually opposing wedge sliding edges 114*a* and 114*b* and running towards one another, which blend into one another in a rounded wedge corner edge 115 and preferably subtend an angle α of 15 to 30°, and preferably 18 to 24°, with one another. The location, centering and guide wedge 106 in this case is appropriately arranged symmetrically in relation to a central plane 116 of the wedge oriented perpendicularly to the front side 112 of the wedge, and exhibits a triangular form in one view seen in the direction of the axis 108 of the lock pin. The thickness of the location, centering and guide wedge 106, that is to say the extent of the peripheral wall 113 of the wedge or the sliding edges 114*a* and 114*b* of the wedge in the direction of the axis 108 of the pin, is preferably 5 to 10 mm, and in particular 4 to 7 mm.

Figure 22:
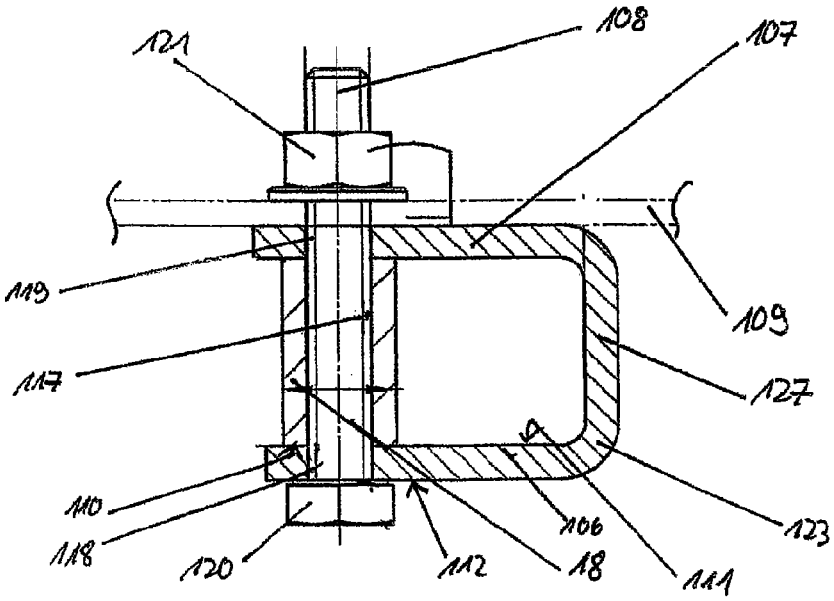
FIG. 22 depicts a section along the line B-B in FIG. 21.
Figure 23:
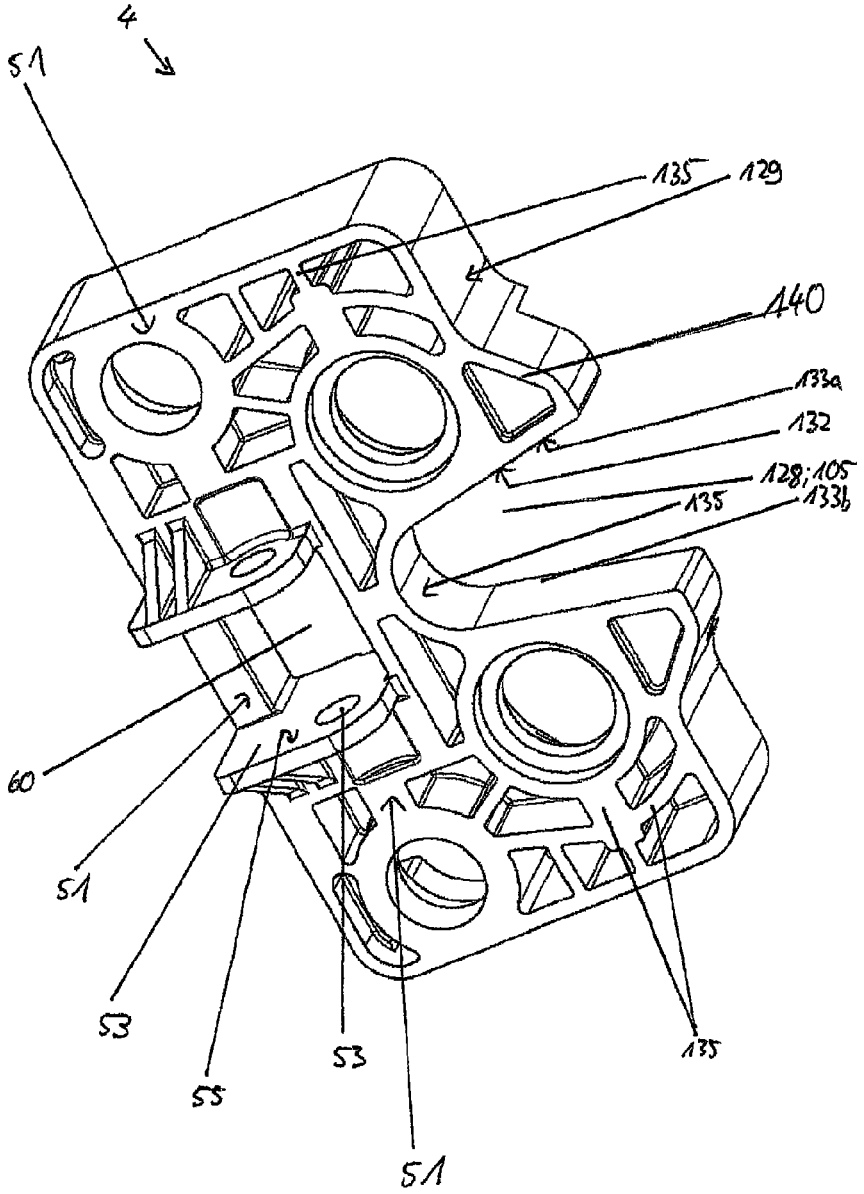
FIG. 23 depicts a perspective external view of a cover for the lock case according to a further embodiment.
Figure 24:
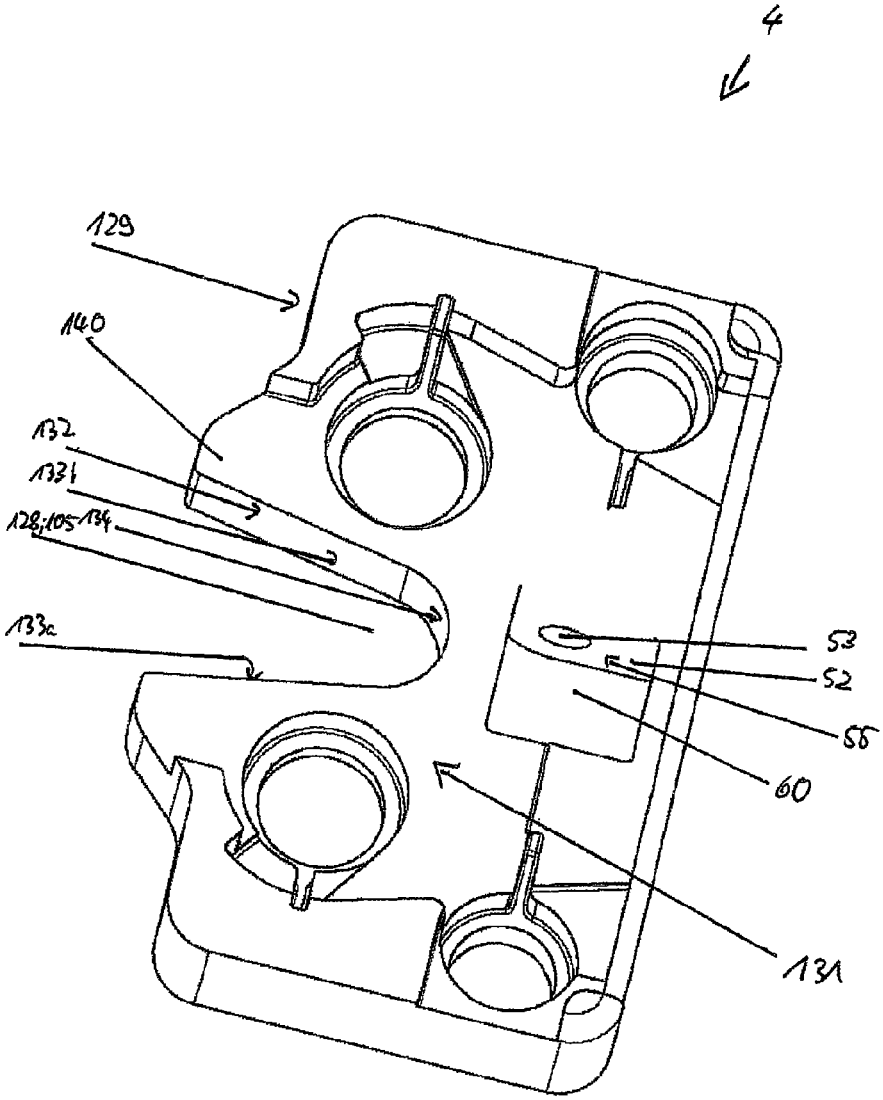
FIG. 24 depicts a perspective internal view of a cover for the lock case according to FIG. 23.

The lock pin 18 and the location, centering and guide wedge 106 are connected to one another in the vicinity of the wedge corner edge 115, in conjunction with which the lock pin 18 is also arranged symmetrically to the central plane 116 of the wedge. In this case, the lock pin 18 is preferably screwed to the location, centering and guide wedge 106. For this purpose, the lock pin 18 exhibits, for example, a hole 117 located centrally in relation to the axis 108 of the lock pin, and the location, centering and guide wedge 106 exhibits in the vicinity of the wedge corner edge 115 a cylindrical screw-accommodating cut-out recess 118 that is from the front side 112 of the wedge to the rear side 111 of the wedge (FIG. 22). In addition, a hole 119 is made in the attachment plate (FIG. 22), which is arranged in alignment with the hole 117 in the lock pin 18. Introduced into the screw-accommodating cut-out recess 118, the hole 117 and the screw-accommodating cut-out recess 118 is a screw 120, which tightens the lock pin 18 to the attachment plate 107 and the location, centering and guide wedge 106 by means of a nut 121.

Figure 19:
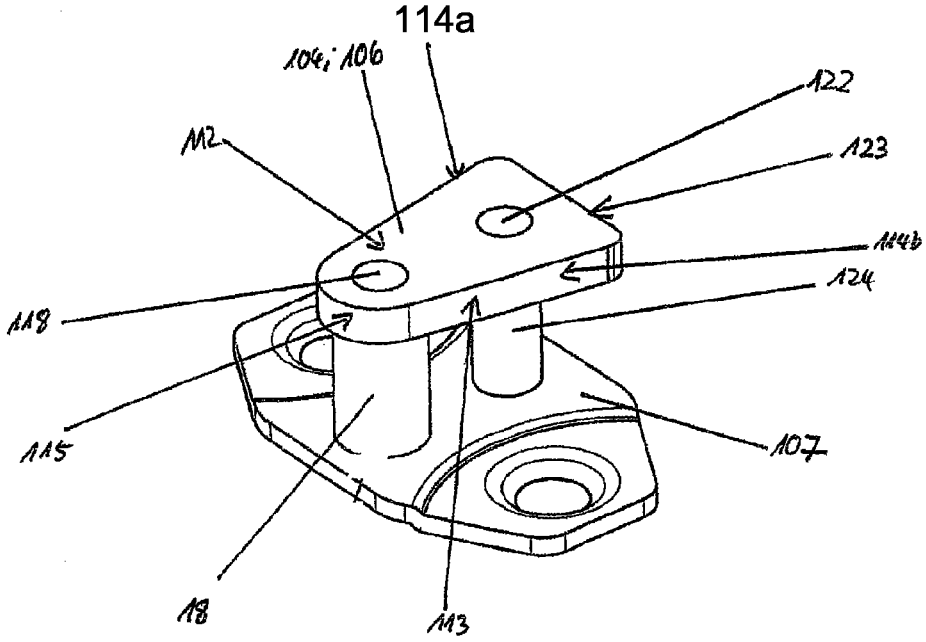
FIG. 19 depicts a perspective view of a lock pin, an attachment plate and a location, centering and guide wedge.
Figure 20:
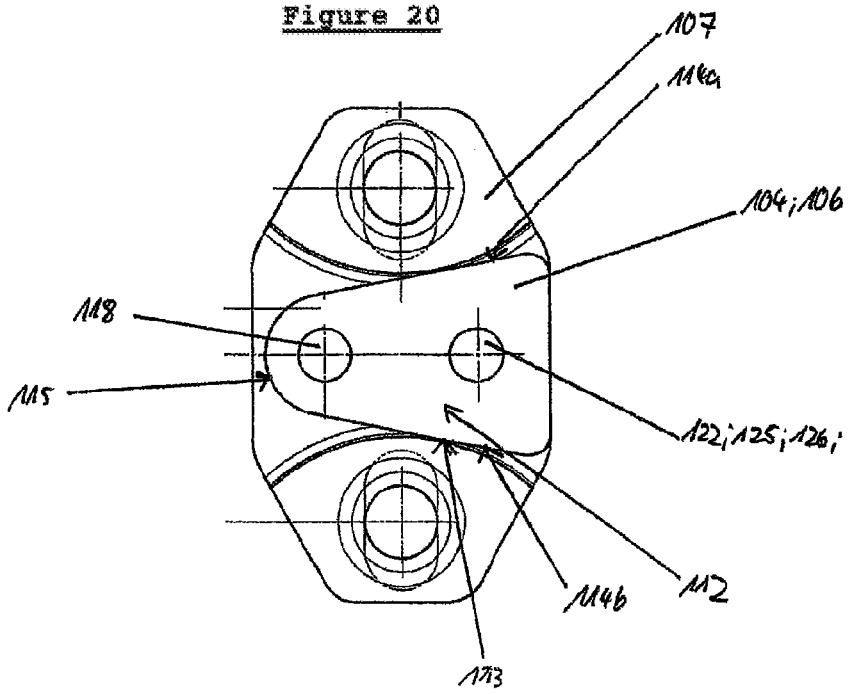
FIG. 20 depicts a view of the component parts in FIG. 19 viewed from the wedge side.
Figure 21:
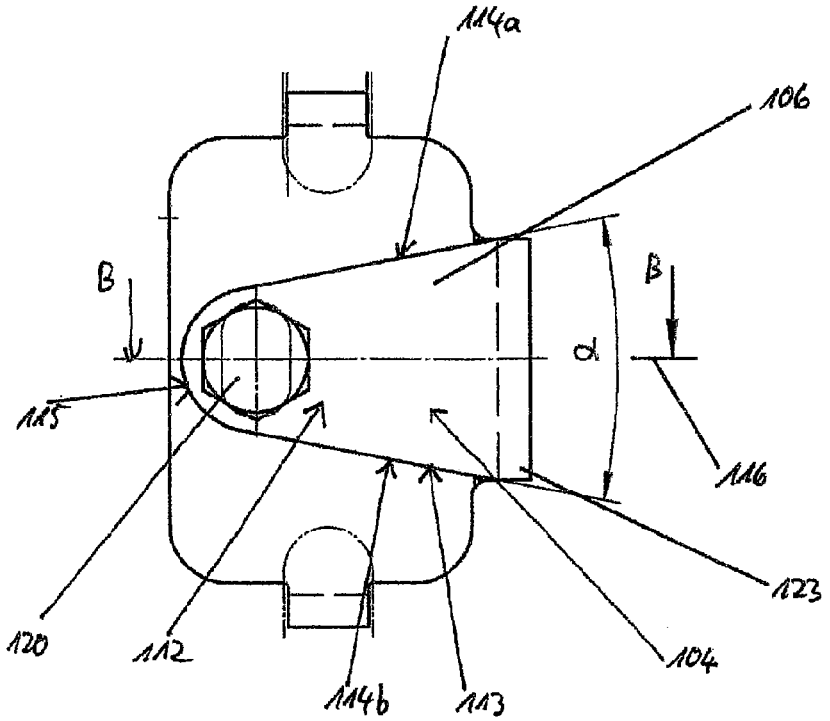
FIG. 21 depicts a view of the component parts in FIG. 19 viewed from the wedge side with a location, centering and guide wedge according to a further embodiment.

In order to prevent twisting of the location, centering and guide wedge 106, the location, centering and guide wedge 106 is appropriately connected additionally, and in particular by screwing, to the attachment plate 107 at a second point (FIGS. 19, 20). For this purpose, the location, centering and guide wedge 106 exhibits, for example, a further cylindrical screw-accommodating cut-out recess 122 that is transcurrent from the front side 112 of the wedge to the rear side 111 of the wedge, which cut-out recess is provided in the vicinity of a wedge lateral edge 123 of the peripheral wall 113 of the wedge situated opposite the wedge corner edge 115. Provided in addition is a connecting pin and distance pin 124 with a central transcurrent cut-out recess 125, which is positioned perpendicularly to the location, centering and guide wedge 106 and parallel to the lock pin 18. In addition, a further transcurrent bore 126 is present in the attachment plate 107.

Also introduced into the second screw-accommodating cut-out recess 122, the transcurrent cut-out recess 125 of the connecting pin and distance pin 124 and the second transcurrent bore 126 of the plate 107 is a screw, which tightens the connecting pin and distance pin 124 to the attachment plate 107 and the location, centering and guide wedge 106 by means of a nut (not illustrated here).

The distance of the two pins 18,124 from one another is dimensioned in this case so that the lock pin 18 is capable of being gripped by the rotary latches 9 and 10.

According to a further embodiment of the invention (FIGS. 21, 22), the location, centering and guide wedge 106 is securely attached to the attachment plate 107 via a web plate 127, in conjunction with which the web plate 127 adjoins the wedge lateral edge 123 of the location, centering and guide wedge 106 and extends preferably perpendicularly to the plate-shaped location, centering and guide wedge 106 and to the attachment plate 107, and also adjoins this. A design of this kind is very simple, since the attachment plate 107 and the location, centering and guide wedge 106 can be manufactured as a single unit, and a supplementary assembly operation and additional component parts are not required.

For the purpose of accommodating, locating, centering and guiding the location, centering and guide wedge 106, the cover 4 of the lock case 2 exhibits, in place of the bell-shaped lock pin cut-out recess 61, a V-shaped or funnel-shaped location, centering and guide cut-out recess 128, which is executed symmetrically to the transversal central plane 15 of the door lock 1 and extends from a longitudinal edge 129 of the cover into the cover 4 and is transcurrent from the external wall 51 of the cover to an internal wall 131 of the cover. The location, centering and guide cut-out recess 128 is delimited by a cut-out recess wall 132, which exhibits two corresponding sliding surfaces 133*a* and 133*b* for the wedge sliding edges 114*a*, 114*b*, which blend into one another via a rounded wall corner edge 134.

Furthermore, additional guide projections 140 preferably adjoin the longitudinal edge 129 of the cover to either side of the location, centering and guide cut-out recess 128 in order to extend the corresponding sliding surfaces 133*a* and 133*b*.

Figure 25:
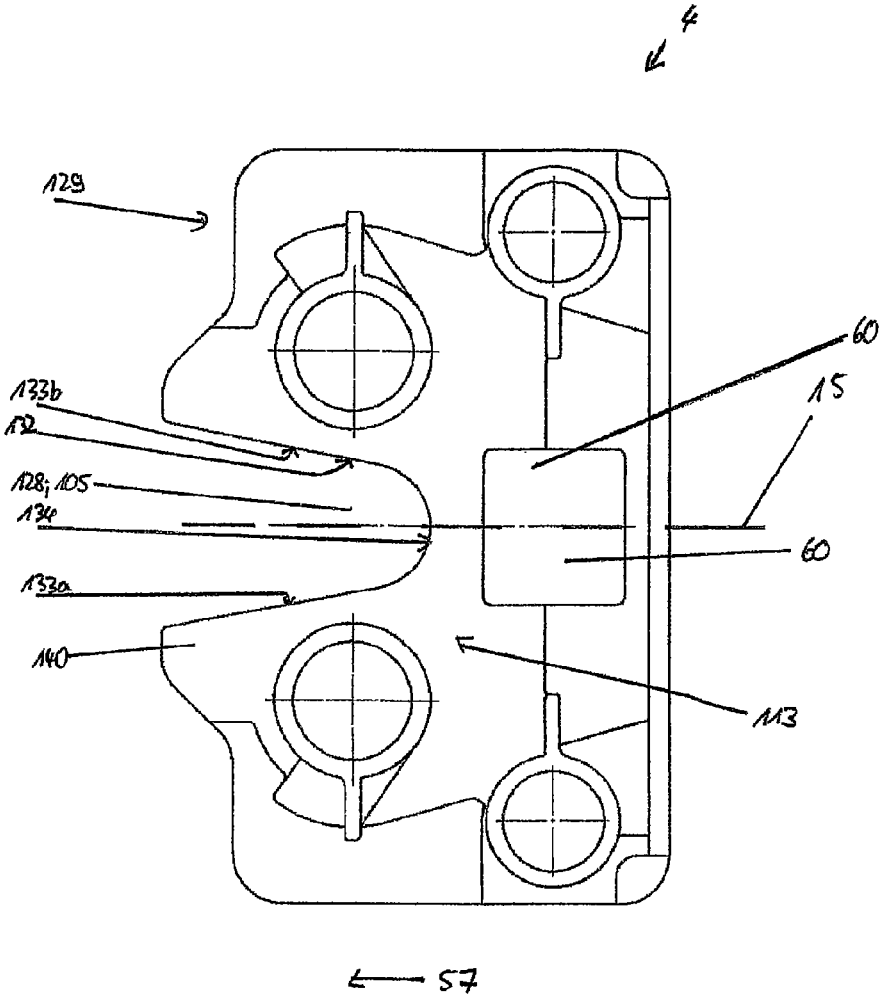
FIG. 25 depicts an internal view of the cover according to FIG. 24.
Figure 26:
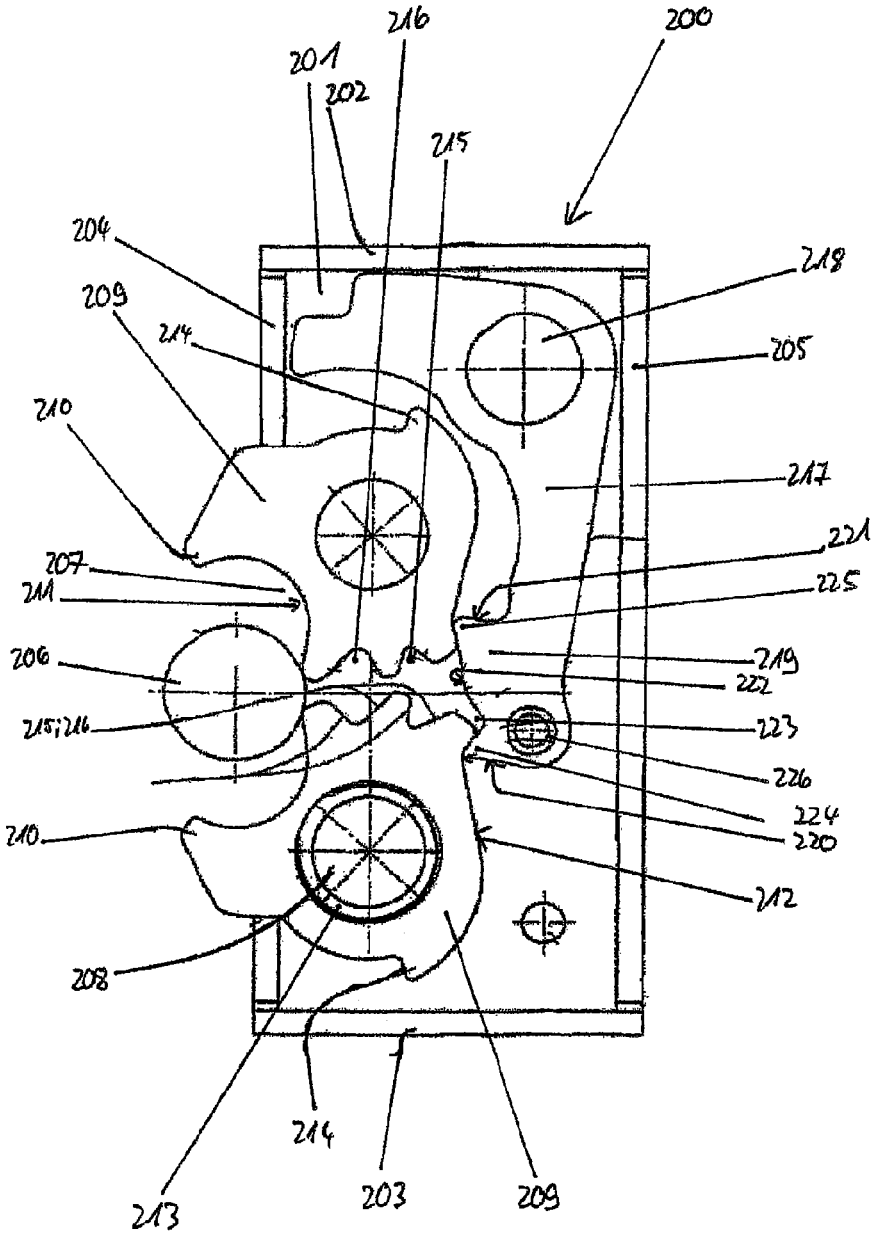
FIG. 26 depicts a longitudinal section of a vehicle door lock according to the prior art viewed from the broad side.

The course of the cut-out recess wall 132 when observed in a view perpendicular to the external wall 51 of the cover (FIG. 25) in this case corresponds to the course of the wedge peripheral wall 113 for the centering of the location, centering and guide wedge 106 when viewed in the direction of the axis 108 of the lock pin, in conjunction with which the location, centering and guide cut-out recess 128 is arranged, when viewed in the direction perpendicular to the external wall 51 of the cover, essentially in alignment with the lock pin cut-out recess 61 provided in the longitudinal wall 6 and the base plate 3.

Furthermore, the cut-out recess wall 132 exhibits an extent of preferably 10 to 20 mm, and in particular 12 to 16 mm in this direction.

In order to achieve a further saving in weight and to create good sliding characteristics, the cover 4 in its entirety appropriately consists of plastic and exhibits stiffening ribs 135. The location, centering and guide wedge 106 in this case preferably consists of metal or plastic.

The mode of operation of the location, centering and guide device according to the invention is now explained in greater detail below:

With the door lock 1 in an opened position, the lock pin 18 and the location, centering and guide wedge 106 are situated outside the lock case 2 between the throats 17 of the two rotary latches 9,10. If the door is closed, the lock pin 18 presses against the door closing direction (arrow 57) against throat walls 56 of the rotary latches 9 and 10 and causes these to pivot in the manner described above, and it is introduced as a result into the lock pin cut-out recess 61 of the lock case 2. At the same time, the location, centering and guide wedge 106 that is securely connected to the lock pin 18 is introduced in advance with the wedge corner edge 115 into the location, centering and guide cut-out recess 128 in this case, in conjunction with which, in the case of a vehicle door that is hung out of alignment, introduction does not take place in a centered manner, but one of the two wedge sliding edges 114*a* and 114*b*, usually the upper wedge sliding edge 114*a*, slides along one of the two corresponding sliding surfaces 133*a* and 133*b*, usually the upper corresponding sliding surfaces 133*a*. In this way, the forces to be applied for the centering of the vehicle door, that is to say generally the weight forces acting via the vehicle door that is hung out of alignment in a downward direction, are transferred from the upper corresponding sliding surface 133*a* to the upper wedge sliding edge 114*a*, and the lock in 18 and the rotary latches 9 and 10 and the lock pin cut-out recess 61 are not subjected to loading as a result.

Because of the conical course of the wedge sliding edges 114*a* and 114*b* and the corresponding sliding surfaces 133*a* and 133*b* and the wedge effect associated therewith, the vehicle door in this case is centered increasingly and continuously and is raised, as appropriate, the further the location, centering and guide wedge 106 is introduced into the location, centering and guide cut-out recess 128. In the centered end position, in which the rotary latches 9 and 10 are present in their engaged position and fully grip the centered lock pin 18, the location, centering and guide wedge 106 is introduced completely into the location, centering and guide cut-out recess 128 and is enclosed with positive engagement by the location, centering and guide cut-out recess 128.

In conjunction with opening the vehicle door, the location, centering and guide wedge 106 is similarly withdrawn continuously to an increasing extent from the location, centering and guide cut-out recess 128, in conjunction with which the upper wedge sliding edge 114*a* slides along the upper corresponding sliding surfaces 133*a*, so that no additional weight forces from the vehicle door act on the lock pin 18 and the lock pin cut-out recess 61.

An advantage associated with the vehicle door lock according to the invention is that the use of two locking pawls means that the release forces in conjunction with opening and closing the door lock are significantly lower than those encountered with the use of only a single locking pawl, so that the doors, which are becoming increasingly large and heavy, can be opened and closed easily and conveniently.

Furthermore, the configuration of the door lock according to the invention with two locking pawls achieves a synergistic effect, since the rotary latches can be of a completely symmetrical design, which considerably simplifies manufacture and assembly, since there is no longer any risk of the two rotary latches being confused with one another during installation.

A further advantage is that the vehicle door lock according to the invention exhibits only a small number of individual component parts. The actuation of the two locking pawls appropriately takes place directly via a single actuating lever, which in turn is actuated directly from the interior of the vehicle. In this way, the cost of production is reduced considerably on the one hand, and on the other hand there is no longer any need for the mutual adjustment of a multi-part lever system during assembly, for example with set screws, or for readjustment after repeated actuations.

The undercut and interlocking configuration of the pawl detent noses together with the corresponding vaulting and/or undercutting of the detent recesses of the rotary latches and the resulting effect engaging from behind ensures very good detent security, since the pawl detent noses make contact with a large area of the detent recesses and in addition the rotary latch springs must be extended slightly in conjunction with the opening.

One advantage associated with the use of the actuating lever of two-part configuration is that the handle lever is not caused to pivot in conjunction with actuation of the door lock from the outside, as a result of which the construction of the two-part actuating lever is surprisingly simple.

The forces normally acting on the lock pin in conjunction with the opening and closing of a vehicle door that is hung out of alignment are absorbed by means of the location, centering and guide device according to the invention, as a result of which the lock pin and the rotary latches and the lock pin cut-out recess are not subjected to loading and are not bent. The forces will already have been absorbed by the above-mentioned guide projections before the pin was able to come into contact with the lock pin cut-out recess. The service life of a vehicle door lock of this kind is increased considerably in this way. In addition, due to the relatively narrow V-shape of the location, centering and guide wedge and the location, centering and guide cut-out recess, the location, centering and guide device exhibits relatively small free play in one direction perpendicular to the transversal central plane of the door lock, so that the centering takes place with small free play.

The use of the location, centering and guide device according to the invention is not restricted, of course, to a door lock with two locking pawls, but is suitable for any door lock with one lock pin and at least one rotary latch engaging around it.

It also falls within the scope of the invention, of course, in the case of very heavy vehicle doors, to provide a further location, centering and guide cut-out recess in the base plate and a second location, centering and guide wedge, in order to distribute the forces more effectively.

While the above description constitutes the preferred embodiment of the present invention, it will be appreciated that the invention is susceptible to modification, variation and change without departing from the proper scope and fair meaning of the accompanying claims.

What is claimed is:

1. A rotary latch lock for closing a vehicle door in a locking way, the rotary latch lock comprising:

a lock case forming a cut-out recess for a lock pin;

a first rotatably mounted rotary latch engageable with the lock pin;

a second rotary latch engageable with the lock pin;

a first rotary latch spring for imposing a force on the first rotary latch;

a second rotary latch spring for imposing a force on the second rotary latch;

a rotatably mounted actuating lever engaging in the lock case;

a first locking pawl configured to pivot relative to the lock case about a first pivot axis; and a guide device configured for locating, centering and guiding the vehicle door in relation to a vehicle body during opening and closing of the vehicle door;

wherein the first rotary latch, the second rotary latch, the first rotary latch spring, the second rotary latch spring, and the first locking pawl are arranged within the lock case;

wherein the first locking pawl is configured to engage both the first rotary latch and the second rotary latch, causing the first and second rotary latches to be maintained in a locked position engaging the lock pin, and wherein the actuating lever is configured to cause the first locking pawl to release the first and second rotary latches from their locked position and allowing the first and second rotary latches to move to release positions allowing the first and second rotary latches to release the lock pin.

2. The rotary latch lock as claimed in claim 1, wherein the guide device comprises a first guide element, which is configured to be rigidly connected to the vehicle body, and a second guide element, which is configured to interact operatively with the first guide element during closing and opening the vehicle door, the second guide element being configured to be securely connected to the vehicle door or to the lock case.

3. The rotary latch lock as claimed in claim 2, further comprising the lock pin, the lock pin being configured to be secured to the vehicle body, wherein the first guide element is rigidly connected to the lock pin.

4. The rotary latch lock as claimed in claim 2, wherein the second guide element is a recess, which the first guide element engages in a centering manner.

5. The rotary latch lock as claimed in claim 4, wherein the first guide element is a guide wedge.

6. The rotary latch lock as claimed in claim 5, wherein the second guide element is a V-shaped guide recess.

7. The rotary latch lock as claimed in claim 5, wherein the guide wedge consists of metal or plastic.

8. A rotary latch lock for closing a vehicle door in a locking way, the rotary latch lock comprising:

a lock case forming a cut-out recess for a lock pin;

a first rotatably mounted rotary latch engageable with the lock pin;

a second rotary latch engageable with the lock pin;

a first rotary latch spring for imposing a force on the first rotary latch;

a second rotary latch spring for imposing a force on the second rotary latch; and a rotatably mounted actuating lever engaging in the lock case;

a first locking pawl configured to pivot relative to the lock case about a first pivot axis:

a second locking pawl configured to pivot relative to the lock case about a second pivot axis that is different than the first pivot axis; and a guide device configured for locating, centering and guiding the vehicle door in relation to a vehicle body during opening and closing of the vehicle door;

wherein the first rotary latch, the second rotary latch, the first rotary latch spring, the second rotary latch spring, the first locking pawl, and the second locking pawl are arranged within the lock case, wherein the first locking pawl is configured to engage the first rotary latch and the second locking pawl is configured to engage the second rotary latch, the first and second locking pawls causing the first and second rotary latches to be maintained in a locked position engaging the lock pin, and wherein the actuating lever configured to actuate the first and second locking pawls, causing them to release the first and second rotary latches from their locked position and allowing the first and second rotary latches to move to release positions allowing the first and second rotary latches to release the lock pin.

9. The rotary latch lock as claimed in claim 8, wherein the guide device comprises a first guide element, which is configured to be rigidly connected to the vehicle body, and a second guide element, which is configured to interact operatively with the first guide element during closing and opening the vehicle door, the second guide element being configured to be securely connected to the vehicle door or to the lock case.

10. The rotary latch lock as claimed in claim 9, further comprising the lock pin, the lock pin being configured to be secured to the vehicle body, wherein the first guide element is rigidly connected to the lock pin.

11. The rotary latch lock as claimed in claim 9, wherein the second guide element is a recess, which the first guide element engages in a centering manner.

12. The rotary latch lock as claimed in claim 11, wherein the first guide element is a guide wedge.

13. The rotary latch lock as claimed in claim 12, wherein the second guide element is a V-shaped guide recess.

14. The rotary latch lock as claimed in claim 12, wherein the guide wedge consists of metal or plastic.

* * * * *